US008500225B2

(12) United States Patent
Kim et al.

(10) Patent No.: US 8,500,225 B2
(45) Date of Patent: Aug. 6, 2013

(54) REINFORCING COMPONENT FOR REFRIGERATOR

(75) Inventors: Young-Bae Kim, Gyeongsangnam-Do (KR); Kyung-Do Kim, Gyeongsangnam-Do (KR); Hyung-Pyo Yoon, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 220 days.

(21) Appl. No.: 12/593,244

(22) PCT Filed: Sep. 5, 2007

(86) PCT No.: PCT/KR2007/004287

§ 371 (c)(1),
(2), (4) Date: Apr. 1, 2010

(87) PCT Pub. No.: WO2008/117911

PCT Pub. Date: Oct. 2, 2008

(65) Prior Publication Data

US 2010/0181883 A1 Jul. 22, 2010

(30) Foreign Application Priority Data

Mar. 26, 2007 (KR) ..... 10-2007-0029387
Mar. 26, 2007 (KR) ..... 10-2007-0029389
Mar. 26, 2007 (KR) ..... 10-2007-0029392
Mar. 26, 2007 (KR) ..... 10-2007-0029393
Mar. 26, 2007 (KR) ..... 10-2007-0029394

(51) Int. Cl.
*A47B 96/04* (2006.01)

(52) U.S. Cl.
USPC ..... 312/406

(58) Field of Classification Search
USPC ..... 312/400, 401, 405, 406.2, 407, 407.1, 312/406
See application file for complete search history.

(56) References Cited

U.S. PATENT DOCUMENTS 3,872,683 A * 3/1975 Blanton ..... 62/140
4,747,245 A * 5/1988 Lesmeister et al. ..... 52/309.7
4,885,865 A * 12/1989 Rumbaugh ..... 43/18.5
5,139,843 A * 8/1992 Murakami et al. ..... 428/116
5,599,081 A * 2/1997 Revlett et al. ..... 312/406
5,669,232 A * 9/1997 Iwamoto et al. ..... 62/296
5,843,558 A * 12/1998 Yoshizaki et al. ..... 428/112
6,036,293 A * 3/2000 Anell et al. ..... 312/406

(Continued)

FOREIGN PATENT DOCUMENTS

JP 1-237130 A 9/1989
JP 07-120138 A 5/1995

(Continued)

*Primary Examiner* — Darnell Jayne
*Assistant Examiner* — Matthew Ing
(74) *Attorney, Agent, or Firm* — Birch, Stewart, Kolasch & Birch, LLP

(57) ABSTRACT

The reinforcing component for a refrigerator, which is formed by mixing a base material as a synthetic resin material and a supplement component formed by arranging reinforcing fibers according to a pultrusion method, and combined with one or more portions of on one portion of an inner side of an outer case of the refrigerator to contact with foam, a corner of the bottom of the refrigerator or in a mechanic chamber of the refrigerator, an outer plate or an inner plate of a door of the refrigerator, and the interior of a side wall forming an inner space of the refrigerator can reduce the weight of the refrigerator while maintaining the strength.

34 Claims, 20 Drawing Sheets

U.S. PATENT DOCUMENTS

| | | | | |
|---|---|---|---|---|
| 6,138,432 | A * | 10/2000 | Banicevic | 52/784.15 |
| 6,209,342 | B1 * | 4/2001 | Banicevic et al. | 62/443 |
| 6,679,006 | B2 * | 1/2004 | Banicevic et al. | 49/501 |
| 6,800,326 | B1 * | 10/2004 | Uchiyama | 427/309 |
| 6,961,988 | B2 * | 11/2005 | Koons | 29/525.11 |
| 7,014,283 | B2 * | 3/2006 | Grace et al. | 312/406 |
| 7,278,279 | B2 * | 10/2007 | Hirai et al. | 62/440 |
| 7,726,149 | B2 * | 6/2010 | Kang et al. | 62/408 |
| 7,815,269 | B2 * | 10/2010 | Wenning et al. | 312/406 |
| 2003/0141793 | A1 * | 7/2003 | Lee | 312/401 |
| 2005/0006997 | A1 * | 1/2005 | Yoshioka | 312/405 |
| 2006/0016049 | A1 * | 1/2006 | Schlichter et al. | 19/98 |

FOREIGN PATENT DOCUMENTS

| | | | |
|---|---|---|---|
| JP | 8-197668 | A | 8/1996 |
| JP | 8-313150 | A | 11/1996 |
| JP | 10-508720 | A | 8/1998 |
| JP | 11-132645 | A | 5/1999 |
| JP | 2001-116444 | A | 4/2001 |
| JP | 2004-125394 | A | 4/2004 |
| JP | 2006-097904 | A | 4/2006 |
| KR | 1997-0047659 | A | 7/1997 |
| KR | 1999-0027614 | U | 7/1999 |
| KR | 10-0512640 | A | 9/2005 |

* cited by examiner

REINFORCING COMPONENT FOR REFRIGERATOR

TECHNICAL FIELD

The present invention relates to a reinforcing component for a refrigerator and, more particularly, to a reinforcing component for a refrigerator capable of preventing deformation of a refrigerator structure due to an external force, also preventing deformation of an internal and external surface of a case having a receptacle space therein or the exterior of a refrigerator door, and reducing the weight of the refrigerator, by fabricating the reinforcing component with a plastic composite material according to a plastic foam or pultrusion method.

BACKGROUND ART

In general, the refrigerator, a device for keeping good items at storage at a low temperature, includes a case having a receptacle space such as a refrigerating chamber or a freezing chamber, etc., a door for opening and closing the refrigerating chamber and the freezing chamber, and a refrigerating cycle that maintains the food items kept in storage.

The case is formed by the combination of an outer plate that forms the exterior shape and an inner plate that forms a storage space, and typically, a polyurethane foam is filled between the outer plate and the inner plate, such that an insulation effect is increased. The same also applies for the door.

A cooling air duct is provided between the inner plate and the outer plate of the case to provide cooling air into the refrigerating chamber or the freezing chamber.

In line with the tendency that refrigerators are becoming multi-functional, additional devices such as a home bar, an ice making device, a dispenser, or the like are installed at the door of the refrigerator.

The receptacle space is divided by a separation wall. The interior of the separation wall is filled with polyurethane foam or with separately fabricated plastic foam.

In general, diverse reinforcing components are provided to the refrigerator in order to reinforce the structure.

First, in filling the polyurethane foam, in a state that the inner plate and the outer plate of the case are assembled, a polyurethane foaming solution is injected between the inner and outer plates and then should be heated to allow the polyurethane foaming solution to be foamed. Thus, a reinforcing component for preventing thermal deformation is provided.

Second, various external forces are applied to the case filled with the polyurethane foam while the refrigerator is fabricated and transported. Thus, a reinforcing component for preventing deformation of the configuration of the case is provided.

Third, in the process of filling foam between the inner and outer plates of the case, a flow of foam filled to the inner plate and that to the outer plate with the cooling air duct interposed there between are different, causing a bent portion on the outer plate. Thus a reinforcing component is provided to prevent it.

Fourth, when the additional devices are installed at the door, a bent portion is generated on the inner plate or the outer plate of the door due to the additional device in the process of filling foam in the door. In this case, a reinforcing component is also provided.

Fifth, the characteristics of a lower end portion of a side wall of the case are such that the quality of the polyurethane foam thereof becomes degraded, which causes deformations or the like on the outer plate of the side wall. Accordingly, a reinforcing component is provided to prevent this from occurring.

Finally, when polyurethane foam is used as the separation wall, the polyurethane foam is contracted to cause a bent portion on the outer plate of the separation wall. Thus, in order to prevent such deformation, a reinforcing component is provided.

However, the above-mentioned related art reinforcing component for a refrigerator has following problems.

The related art refrigerator reinforcing component is made of iron to acquire high strength, which makes the weight of the refrigerator heavy. Thus, when the refrigerator is shipped for transportation, it can hardly use a conveyer system.

In addition, 25 countries of the European Union established WEEE (Waste Electrical and Electronic Equipment) regulates that electrical and electronic equipment wasted in the zone of the European Union should be obligatorily marked and retrieved. According to this regulation, a deposit is calculated in proportion to the weight of the refrigerator, degrading price competitiveness in exporting refrigerators.

Moreover, the related art reinforcing component does not take an applied load condition into consideration, failing to have an effective structure.

TECHNICAL GIST OF THE PRESENT INVENTION

The present invention has been devised to solve the problem of the related art and an object of the present invention is to provide a reinforcing component for a refrigerator capable of reducing the weight of a refrigerator and reducing a fabrication cost.

Another object of the present invention is to provide a reinforcing component for a refrigerator adapted for a load condition at a location where the reinforcing component is installed.

To achieve the above objects, there is provided a reinforcing component for a refrigerator, including: a base component made of a synthetic resin material; and a supplement component formed by arranging reinforcing fibers, whereby the base component and the supplement component are mixed and formed according to a pultrusion method to allow contact with a foam material upon attachment to one portion of an inner surface of an outer case of the refrigerator.

Here, the supplement component is formed such that the reinforcing fibers are arranged to cross each other or arranged in parallel to each other.

The reinforcing component has a square shaped or an I-shaped cross-section.

The base material is epoxy or polyester.

The reinforcing component includes a combining hole formed at one side thereof so as to be combined with a front surface of a side wall constituting an internal space of the refrigerator.

To achieve the above objects, there is also provided a reinforcing component for a refrigerator, including: a base component made of a synthetic resin material; and a supplement component formed by arranging reinforcing fibers, whereby the base component and the supplement component are mixed and formed according to a pultrusion method, and installed at a corner of the bottom of the refrigerator or in a mechanic chamber of the refrigerator.

The supplement component is formed by alternately stacking a fibrous layer with the reinforcing fibers arranged to be parallel to each other and a fibrous layer with the reinforcing fibers arranged to cross each other.

Preferably, the supplement component is formed by stacking at least two or more fibrous layers with the reinforcing fibers arranged to cross each other.

The reinforcing component has an 'L' shape.

The reinforcing component has such a cross-sectional shape that two different members are connected.

The base material is epoxy or polyester.

The reinforcing component includes a combining hole formed at one side thereof so as to be combined with a corner of the bottom of the refrigerator or a mechanic chamber of the refrigerator.

To achieve the above objects, there is also provided a reinforcing component for a refrigerator, which is formed by mixing a base material as a synthetic resin material and a supplement component formed by arranging reinforcing fibers according to a pultrusion method, and installed on an outer plate or an inner plate of a door of the refrigerator.

The reinforcing component includes: a supporter attached on the outer plate or inner plate of the refrigerator door; and at least one or more ribs formed to protrude from a surface of the supporter.

The supplement component is formed by arranging the reinforcing fibers such that they have at least two or more directionality.

The base material is epoxy or polyester.

When two or more ribs are formed, the ribs are formed to be parallel to each other.

To achieve the above objects, there is also provided a reinforcing component for a refrigerator, including: a base component made of a synthetic resin material; and a supplement component formed by arranging reinforcing fibers, whereby the base component and the supplement component are mixed and formed according to a pultrusion method in order to form a handle of a door of the refrigerator.

A spray coated film is formed on an outer circumferential surface of the handle.

The supplement component is formed by arranging the reinforcing fibers such that they are parallel to a lengthwise direction of the handle.

The base material is epoxy or polyester.

To achieve the above objects, there is also provided a reinforcing component for a refrigerator, including: a base component made of a synthetic resin material; and a supplement component formed by arranging reinforcing fibers, whereby the base component and the supplement component are mixed and formed according to a pultrusion method, and installed at the interior of a side wall forming an inner space of the refrigerator.

The reinforcing component includes: a supporter installed between an outer plate of the side wall and a duct that supplies cooling air into the inner space of the refrigerator; and a blade formed to be bent toward the duct at an end of the supporter.

The supporter includes multiple holes.

The supplement component is formed by arranging the reinforcing fibers such that they have at least two or more directionality.

The base material is epoxy or polyester.

To achieve the above objects, there is also provided a reinforcing component for a refrigerator, which includes plastic foam installed at an inner side of an outer plate of a side wall forming an inner space of the refrigerator and having a through hole to allow a foaming solution filling the interior of the side wall to flow therethrough.

Here, multiple through holes are formed to be spaced apart from each other.

The through holes have a circular shape and the distance between the through holes is 3 times to 15 times the diameter of the through holes.

The plastic foam is made of polyurethane, epoxy or polyester.

The plastic foam is installed to be spaced apart from an inner surface of the side wall.

To achieve the above objects, there is also provided a reinforcing component for a refrigerator, that may include: plastic foam installed at an inner side of a separation wall dividing an inner space of the refrigerator; a foaming solution receiving part formed to be recessed on an upper surface of the plastic foam and filled with a foaming solution that fills the interior of the separation wall; at least one or more cavities formed to be recessed on a lower surface of the plastic foam; and a first communicating hole allowing the foaming solution receiving part and the cavities to communicate with each other.

Here, the reinforcing component further includes: an inlet formed on the upper surface of the plastic foam and guiding the foaming solution so as to be introduced into the foaming solution receiving part.

The foaming solution flows to the cavities from the foaming solution receiving part through the first communication hole.

The reinforcing component further includes: a foaming solution flow path formed on the lower surface of the plastic foam to guide the foaming solution so as to be introduced to and filled in the separation wall.

The reinforcing component further includes: a second communicating hole allowing the foaming solution flow path and the foaming solution receiving part to communicate with each other.

The foaming solution flows to the foaming solution receiving part through the foaming solution flow path after passing through the second communicating hole.

The plastic foam is made of polyurethane, epoxy or polyester.

According to the present invention, because the reinforcing component for a refrigerator is formed by mixing a base material together with the supplement material made of reinforcing fibers according to the pultrusion method, the reinforcing component that maintains its strength, even though its weight is reduced, is provided.

In addition, because the present invention employs the pultrusion method as the method for forming the reinforcing component for a refrigerator, reinforcing component with a certain section can be mass-produced at a low cost.

Also, the reinforcing component for a refrigerator with a proper section configuration can be applied to a suitable position through a structural strength analysis.

Moreover, because the deformation of the external appearance of the side wall or the separation wall of the case is prevented by using the plastic foam, the weight of the refrigerator can be reduced and users' aesthetic demands can be satisfied.

MODE FOR CARRYING OUT THE PREFERRED EMBODIMENTS

The construction and operation according to a first exemplary embodiment of the present invention will now be described in detail with reference to the accompanying drawings.

Figure 1:
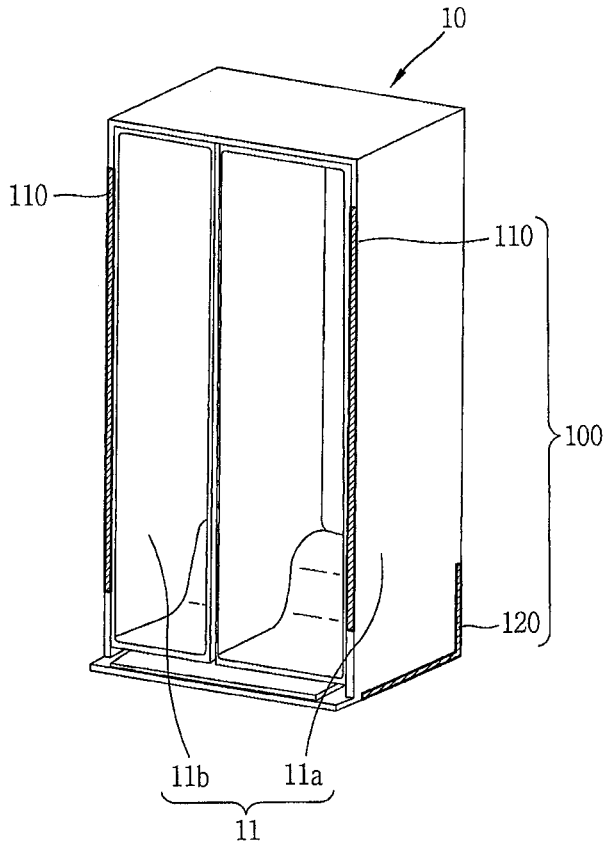
FIG. 1 is a perspective view showing a case of a refrigerator with reinforcing components according to a first exemplary embodiment of the present invention.

FIG. 1 is a perspective view showing a case of a refrigerator with reinforcing components according to the first exemplary embodiment of the present invention.

With reference to FIG. 1, reinforcing components 100 according to the first exemplary embodiment of the present invention are combined with one portion of an inner side of an outer case of a refrigerator 10 so as to contact with foam. Preferably, the reinforcing component 100 is installed in an I shape on the front surface of a side wall of the case 11 forming an inner space of the refrigerator 10. In addition, the reinforcing component 100 according to the first exemplary embodiment of the present invention is installed in an L shape at a corner of the bottom of the refrigerator 10 or at a side wall of a mechanic chamber (not shown) of the refrigerator 10.

The case 11 is formed by the combination of an outer plate 11*a* forming the external appearance and an inner plate 11*b* forming a receptacle space, between which polyurethane foam is typically filled to increase an insulation effect.

The I-shaped reinforcing component 110 is to prevent thermal deformation of the case that may be caused by heat generated in the process of filling polyurethane foam in the case 11.

The I-shaped reinforcing component 110 has a length corresponding to 60% to 95% of the overall height of the refrigerator 10. Because the confirmation of the I-shaped reinforcing component is similar to the alphabet I, it is called the I-shaped reinforcing component for the sake of convenience.

The L-shaped reinforcing component 120 serves to prevent deformation due to various external forces working on the case 11 filled with polyurethane foam while the refrigerator 10 is manufactured and transported. In other words, the L-shaped reinforcing component 120 is to reinforce a structure strength and an impact strength of the refrigerator.

With the configuration similar to the alphabet the L-shaped reinforcing component 120 is called the L-shaped reinforcing component.

Figure 2:
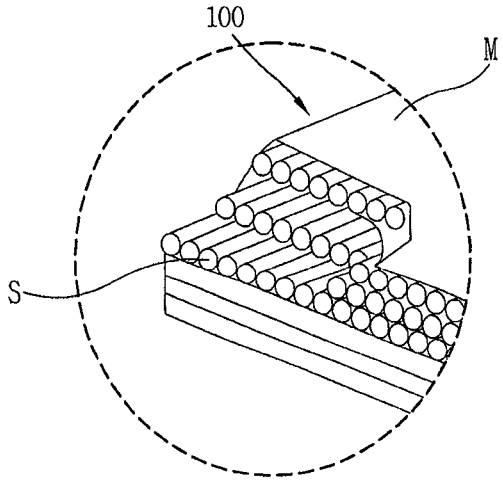
FIG. 2 is a cut-out perspective view showing the structure of the reinforcing component of the refrigerator according to the first exemplary embodiment of the present invention.
Figure 3:
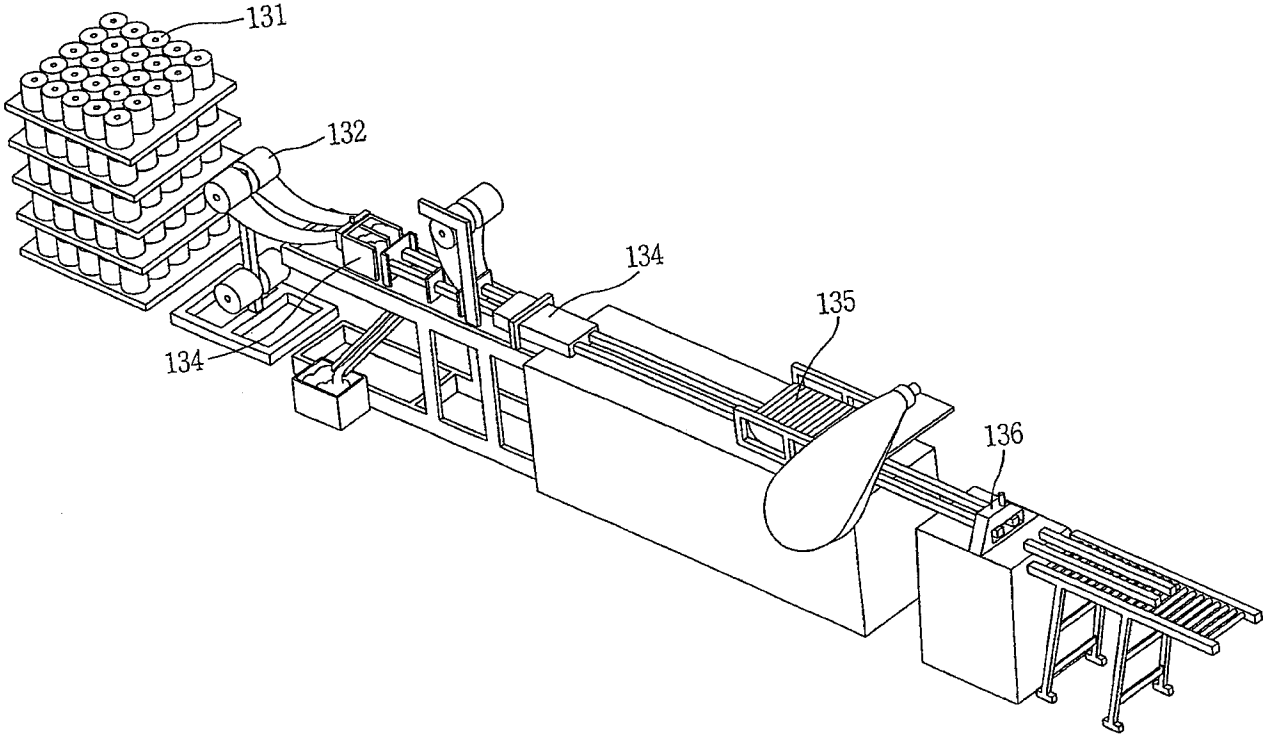
FIG. 3 is a perspective view showing a system for forming the reinforcing component for the refrigerator in FIG. 2.
Figure 4:
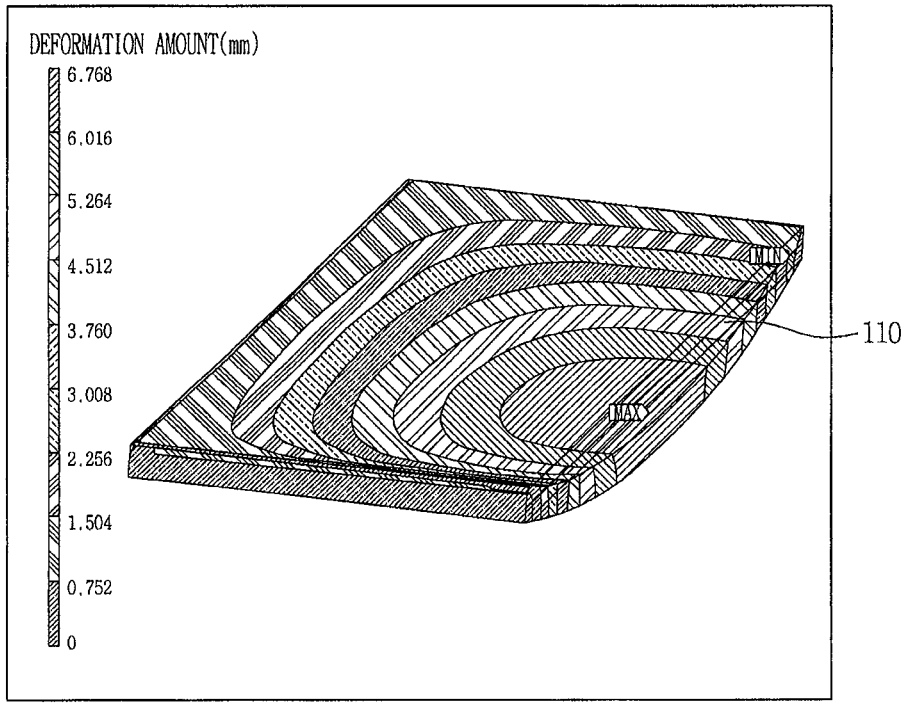
FIGS. 4 and 5 are graphs showing a thermal deformation amount of an I-shaped reinforcing component among the components for the refrigerator in FIG. 2.
Figure 5:
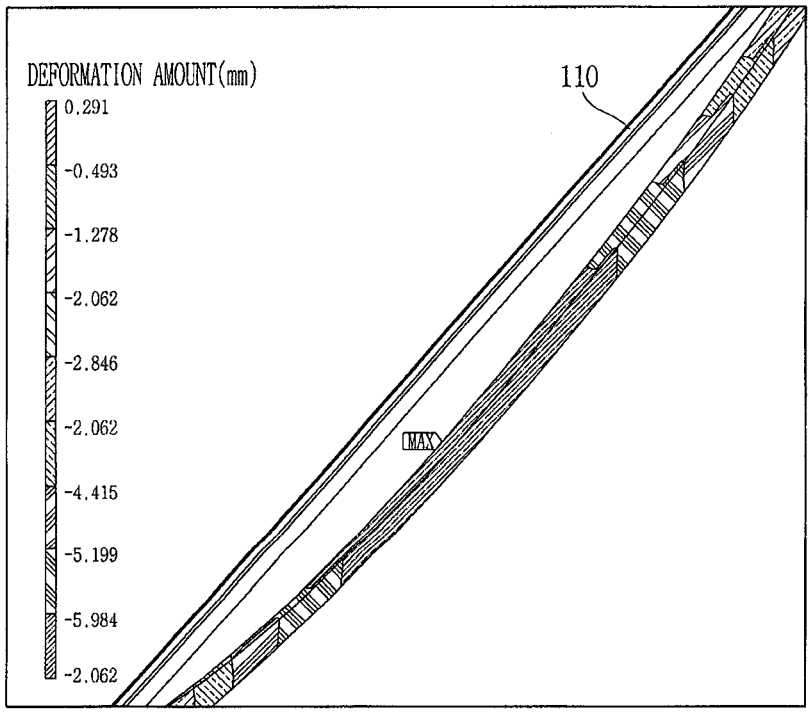
Figure 6:
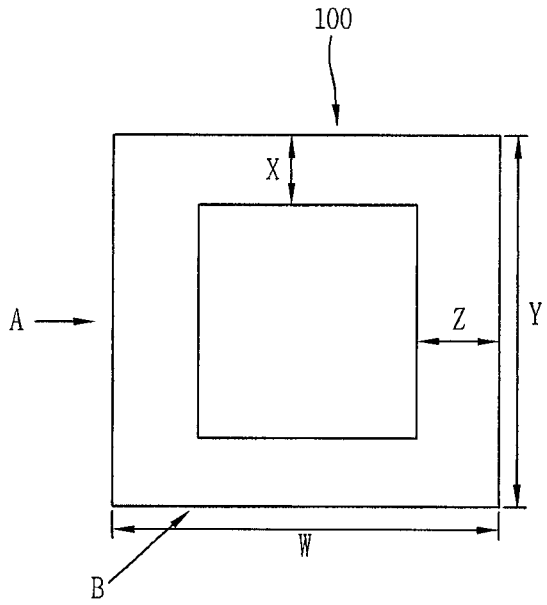
FIGS. 6 and 7 are sectional views of the I-shaped reinforcing component among the components for a refrigerator in FIG. 2.
Figure 7:
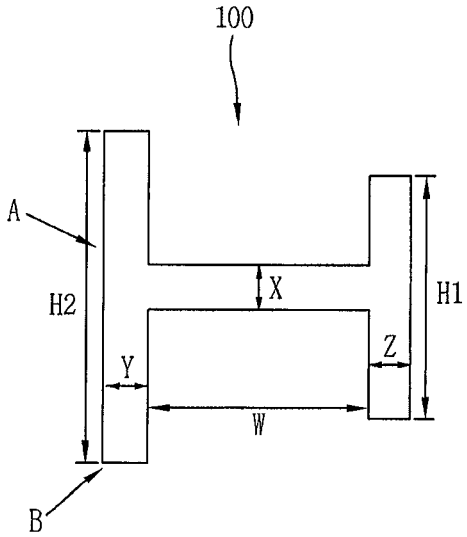
Figure 8:
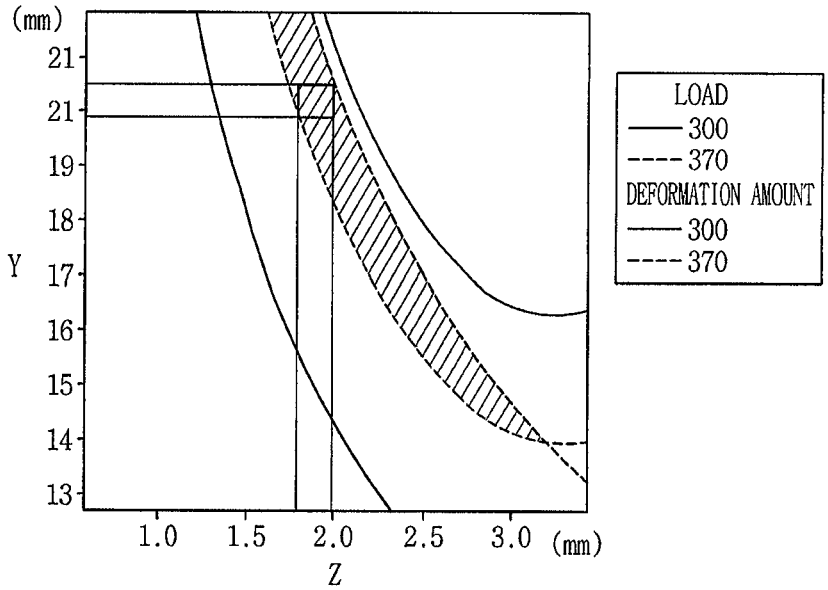
FIG. 8 is a graph showing interpretation of optimization of a sectional dimension of the I-shaped reinforcing component in FIG. 6.

FIG. 2 is a cut-out perspective view showing the structure of the reinforcing component of the refrigerator according to the first exemplary embodiment of the present invention, FIG. 3 is a perspective view showing a system for shaping the reinforcing component for the refrigerator in FIG. 2, FIGS. 4 and 5 are graphs showing a thermal deformation amount of an I-shaped reinforcing component among the components for the refrigerator in FIG. 2, FIGS. 6 and 7 are sectional views of the I-shaped reinforcing component among the components for a refrigerator in FIG. 2, and FIG. 8 is a graph showing interpretation of optimization of a sectional dimension of the I-shaped reinforcing component in FIG. 6.

The reinforcing component 100 according to the first exemplary embodiment of the present invention is formed by mixing a base material (M) as a synthetic resin material and a supplement component (S) formed by arranging reinforcing fibers according to a pultrusion method, and installed in the 'I' shape on the entire surface of the side wall forming the inner space of the refrigerator or installed at a corner of the bottom of the refrigerator or at a mechanic chamber of the refrigerator.

That is, as shown in FIG. 2, the reinforcing component 100 is fabricated by combining the fibers, the supplement component (S), to the base material (M). The reinforcing component 100 formed by combining the base station (M) and the supplement component (S) is superior to iron or aluminum in a specific strength. Each specific strength of the iron and aluminum is 0.3 and 0.5, but the specific strength of the reinforcing components 100 and 200 according to the first exemplary embodiment of the present invention is 5.7.

Accordingly, the reinforcing component 100 according to the first exemplary embodiment of the present invention has the same strength as that of the existing steel reinforcing component but its weight can be minimized.

As the base material (M) various resins may be used, and it would be most effective to use epoxy or polyester in terms of costs. In addition, as the reinforcing fibers constituting the supplement component (S), glass fibers which are low-priced and have a suitable strength are used.

However, the material of the supplement component (S) of the reinforcing component 100 according to the first exemplary embodiment of the present invention is not limited to the glass fibers, but nonmetal fibers such as boron, caron, graphite, Kevlar, etc., may be also used as the material of the supplement component (S).

There may be several methods for forming the reinforcing component by mixing the base material (M) and the supplement component (S), and it is most suitable to form the reinforcing component by using the pultrusion method in order to maximize the strength of the reinforcing component and reduce the fabrication cost.

With reference to FIG. 3, a reinforcing component forming device 130 includes fiber spools 131 with reinforcing fibers constituting the supplement component (S) wound therearound, reinforcing fibers 131 132 wound around the fiber spools 131, a resin infiltration container 133 having a resin as a base material (M) to be mixed with the reinforcing fibers 132, a metal mold 134 for forming the shape of the mixture of the reinforcing fibers 132 and the resin which has passed through the resin infiltration container 133 and hardening it, a drawing unit 135 for extracting long the mixture of the resin and reinforcing fibers 132 which has passed through the metal mold 134, and a cutter 136 for cutting the mixture of the resin and reinforcing fibers 132 which has passed through the drawing unit to have a desired length.

Here, the metal mold 134 has a section with a uniform shape and is heated. The pultrusion method is a method for continuously forming a product with a uniform section. By using the metal mold with a uniform sectional shape, the section of the product can be uniform, and by heating the metal mold, the shape of the product can be maintained and hardened.

The method for forming the reinforcing component 100 according to the first exemplary embodiment of the present invention by using the reinforcing component forming device 130 includes: a step (S1) of infiltrating the resin, the base material, into the reinforcing fibers 132; a step (S2) of hardening the base material-infiltrated reinforcing fibers 132 by the metal mold 134 to shape the reinforcing component 100; a step (S3) of drawing the reinforcing component 100 formed by the metal mold 134 by using the drawing unit 135; and a step (S4) of cutting the reinforcing component 100 which has passed through the drawing unit 135 by using the cutter 136.

Through this method, the reinforcing component 100 according to the first exemplary embodiment of the present invention can be formed with the same strength and the same section in a lengthwise direction at a low cost, and because the reinforcing component can be formed long, it is suitable for mass production.

The reinforcing component 100 according to the first exemplary embodiment of the present invention includes the I-shaped reinforcing component 110 that can be attached on the entire surface of the side wall of the refrigerator 10 to reinforcing the structure strength, and the L-shaped reinforcing component 120 that can be attached at the corner of the bottom surface of the refrigerator 10 or at the mechanic chamber of the refrigerator 10 to reinforce the structure strength. In order to obtain a maximum strength while maintaining a possible minimum weight, the design of the sectional configuration, dimension selection and a method for arranging reinforcing fibers are based on a structural analysis according to a load or the like. First, the I-shaped reinforcing component 110 will now be described.

First, the I-shaped reinforcing component 110 formed according to the pultrusion method may select a section by comparing section coefficients of sections of various shapes. [Table 1] shows sectional coefficients and thermal deformation amount of an iron material and a composite material according to three sectional shapes.

TABLE 1

| Sectional shape of I-shaped reinforcing component | Sectional coefficient | Thermal deformation | Material |
|---|---|---|---|
| L-shaped cross-section | 305 | 6.7 | Iron material |
| Square shaped cross-section | 833 | 5.9 | Composite material |
| I-shaped cross-section | 873 | 6.5 | Composite material |

As shown in [Table 1], it is noted that the square shaped or the I-shaped cross-section is superior to the conventional L-shaped cross-section in the aspect of the section coefficient or the thermal deformation amount. Thus, it would be more appropriate to design the I-shaped reinforcing component 110 with the square shaped cross-section or the I-shaped cross-section.

Here, how to determine the substantial dimensions of the square shaped cross-section or the I-shaped cross-section of the I-shaped reinforcing component 110 is a question. The thermal deformation amount is analyzed by inserting the I-shaped reinforcing component 110 to the structure of the insulation wall of the refrigerator and the most suitable size and configuration are determined by using a six-sigma (6σ) tool.

With reference to FIGS. 4 and 5, it is noted that the I-shaped reinforcing component 110 receives a bending force or a bending moment at its central portion. That is, it is considered that the I-shaped reinforcing component 110 receives the bending force or the bending moment in its lengthwise direction.

According to structural analysis, the I-shaped reinforcing component 110 mainly receives a uni-directional load, thus it is sufficient to have the reinforcing fibers arranged in one direction or in two directions. Namely, the reinforcing fibers of the supplement component (S) are arranged in two directions such that they cross each other, or arranged in one direction such that they are parallel to each other. Preferably, the reinforcing fibers of the supplement component (S) are arranged in the same direction as the lengthwise direction of the I-shaped reinforcing component 110.

In a state with the reinforcing fibers being arranged as such, the base material (M) made of resin seeps in between the reinforcing fibers and then hardened, to thus obtain a high strength reinforcing component 110 made of a composite material.

With reference to FIG. 6, dimensions of each part of the I-shaped reinforcing component 110 with the square shaped section are determined by the graph as shown in FIG. 8. Here, X and Z are thickness, W and Y are the horizontal and vertical lengths, and A and B indicate an outer surface of the I-shaped reinforcing component 110 with the square shaped cross-section. In order to optimize the I-shaped reinforcing component 110 with the square shaped cross-section, the configuration of the section is optimized by using the six-sigma tool while changing the X, Y and Z values.

Regarding the graph in FIG. 8, when the X value is 2.0, the Z and Y regions having an optimum value are indicated in white color.

When the 'A' face of the I-shaped reinforcing component 110 with the square shaped cross-section is attached to the side wall of the refrigerator 10 by using a tape, the optimum X, Y, Z and W values should be determined in consideration of various conditions together. Each condition varies depending on the attachment position of the I-shaped reinforcing component 110 with the square shaped cross-section, the structure of the refrigerator 10 and the desired weight. When the six-sigma tool is used, the optimum values can be obtained when the X value is within the range of about 0.5 mm to 5 mm and the Z value is within the range of about 0.5 mm to 10 mm. Accordingly, the Y and W values that may satisfy the X and Z values can be selected.

FIG. 7 shows the I-shaped reinforcing component 110 with the I-shaped cross-section. H1 and H2 are height, X, Y and Z are thickness, and W indicates width. 'A' and 'B' indicate the outer surface of the I-shaped reinforcing component 110 with the I-shaped cross-section.

When the section dimensions of the I-shaped reinforcing component 110 with the I-shaped cross-section are determined by using the six-sigma tool, they should be optimized by making the X value be within the range of 0.5 mm to 5 mm and Y and Z values be within the range of 0.5 mm to 10 mm.

The L-shaped reinforcing component 120 according to the first exemplary embodiment of the present invention will now be described.

Figure 9:
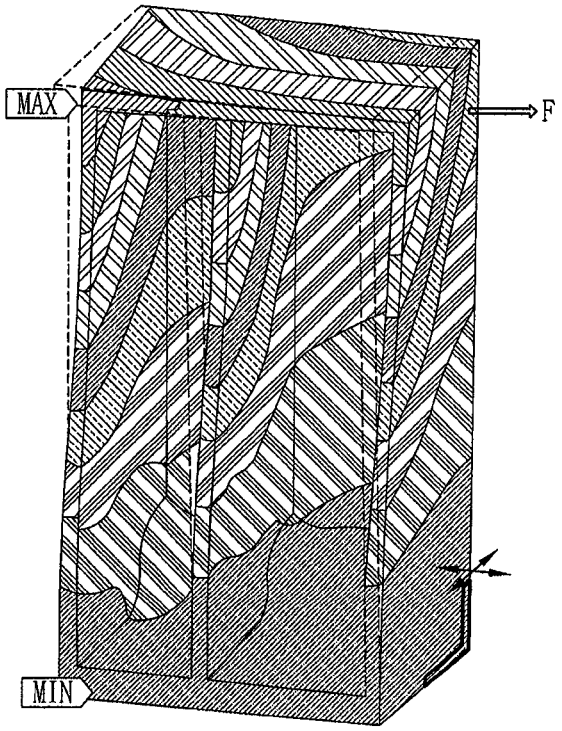
FIG. 9 is a graph showing interpretation of a load applied to an L-shaped reinforcing component among the components for a refrigerator in FIG. 2.
Figure 10:
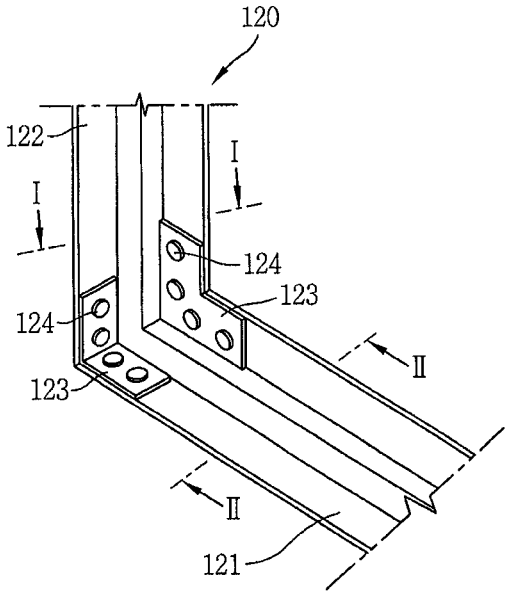
FIG. 10 is a perspective view showing the L-shaped reinforcing component in FIG. 2.
Figure 11:
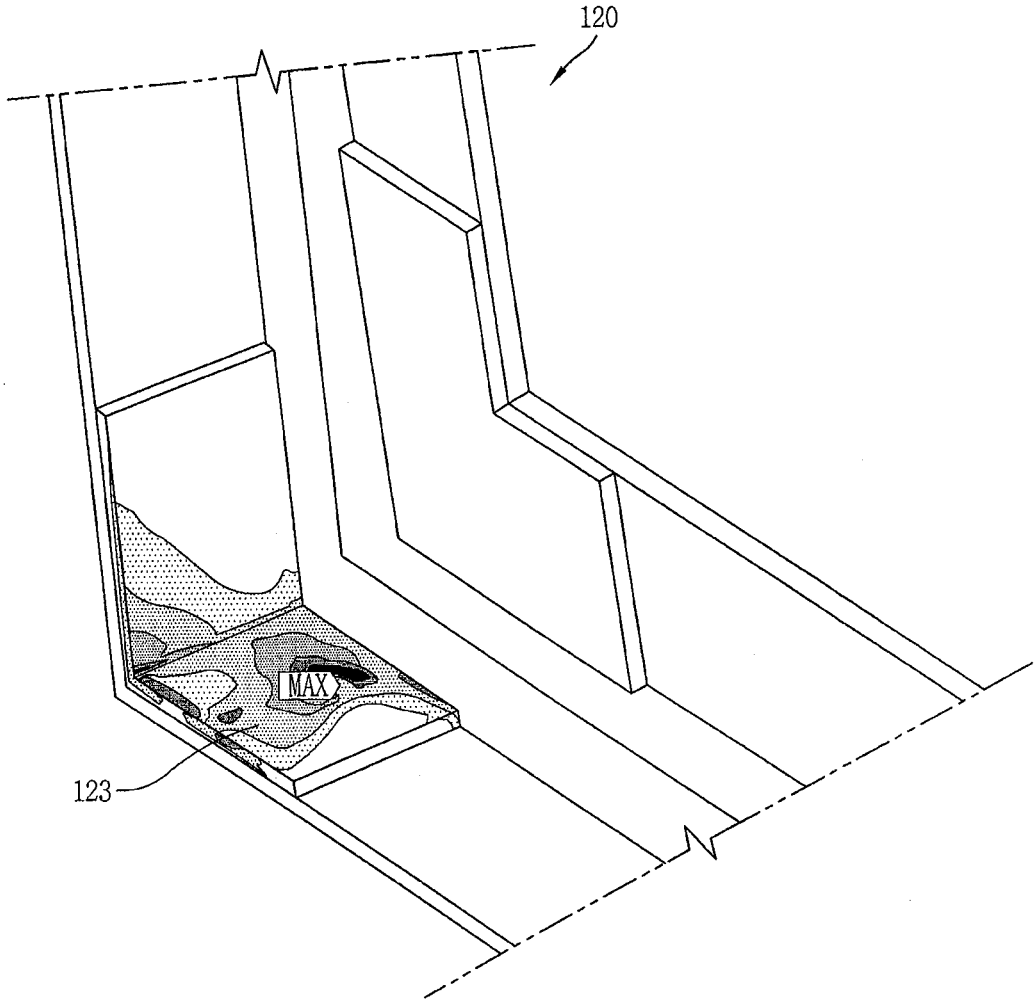
FIG. 11 is a graph showing interpretation of a load of an L-shaped reinforcing component connection part in FIG. 10.
Figure 12:
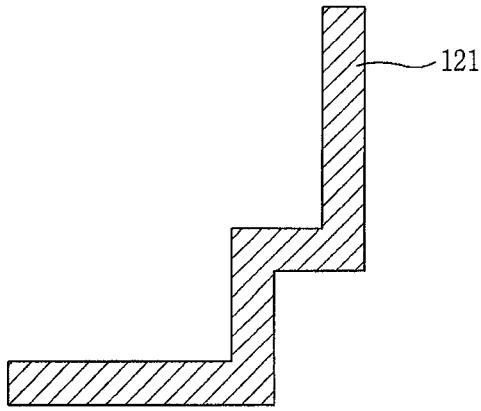
FIG. 12 is a sectional view taken along line I-I in FIG. 10.
Figure 13:
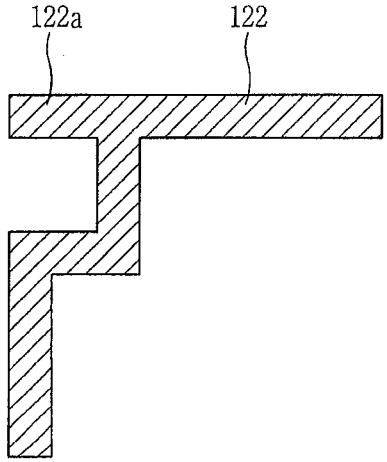
FIG. 13 is a sectional view taken along line II-II in FIG. 10.

FIG. 9 is a graph showing interpretation of a load applied to an L-shaped reinforcing component among the components for a refrigerator in FIG. 2, FIG. 10 is a perspective view showing the L-shaped reinforcing component in FIG. 2, FIG. 11 is a graph showing interpretation of a load of an L-shaped reinforcing component connection part in FIG. 10, FIG. 12 is a sectional view taken along line I-I in FIG. 10, and FIG. 13 is a sectional view taken along line II-II in FIG. 10.

When the reinforcing component 100 made of the composite material described above is implemented as an L-shaped reinforcing component 120 of a refrigerator, it is effective to optimize the configuration by performing structural strength analysis of the refrigerator such that the reinforcing component 120 would have minimal weight and maximal strength.

As shown in FIG. 9, the load (F) is applied from the left and right directions at the top end of the case of the refrigerator 10, and at this time, regarding the forces being applied to the L-shaped reinforcing component 120, structural analysis reveals that along the direction of the applied load (F), not only is a bending force received, but also, a torsional moment (force) is received. Besides, the typical load is applied to the L-shaped reinforcing component 120 in the left and right diagonal directions (refer to the solid line arrows), which is more complicate than the load characteristics of the I-shaped reinforcing component 110.

Thus, in forming the L-shaped reinforcing component 120, the arrangement direction of reinforcing fibers forming the supplement component (S) should be different from that of the I-shaped reinforcing component 110. If the reinforcing fibers of the L-shaped reinforcing component 120 are arranged only in one direction or both directions, the L-shaped reinforcing component 120 would easily weaken without tolerating the torsional moment. So, in order to prevent this, the reinforcing fibers of the L-shaped reinforcing component 120 needs to be formed such that a layer formed by arranging fibers in one direction in parallel in a lengthwise direction and a layer formed by arranging fibers in both direction to cross each other in the lengthwise direction are suitably stacked.

Because the fibrous layer with the fibers arranged in both directions to cross each other can tolerate a higher strength than that with the fibers arranged in one direction, the supplement component (S) of the L-shaped reinforcing component 120 according to the first exemplary embodiment of the present invention is formed by staking at least two or more fibrous layers with fibers arranged in both directions to cross each other to tolerate the higher strength.

The L-shaped reinforcing component 120 simultaneously supports the bottom of the refrigerator 10 and a rear surface of a lower portion of the refrigerator 10. Namely, as shown in FIG. 10, a first member 121 of the L-shaped reinforcing component 120 supports the bottom of the refrigerator 10 and a second member 122 of the L-shaped reinforcing component 120 support the rear surface of the lower portion of the refrigerator 10.

Here, because the load characteristics of the first and second members 121 and 122 are different, the first and second members 121 and 122 have each different sectional shape, respectively.

The first and second members 121 and 122 are formed by a reinforcing component forming device 130 having the metal mold 134 each with a different sectional shape according to the pultrusion method.

In order for the L-shaped reinforcing component 120 including the two members 121 and 122 to have the sufficient structures strength, the two members 121 and 122 should be firmly combined. For this purpose, the first and second members 121 and 122 are brought into contact with each other, a connection member 123 is attached on the surfaces of the both members, and then the members 121 and 122 and the connection member 123 are connected by using rivets 124. One of the connection members connects the contact surface of the first member disposed at the bottom of the refrigerator with the contact surface of the second member disposed at the rear wall of the refrigerator. The other of the connection members connects the contact surface of the first member horizontally disposed at the side wall of the refrigerator with the contact surface of the second member vertically disposed at the side wall of the refrigerator.

In order to connect the two members 121 and 122 with a certain strength, besides the rivets 124, bolts or the like can be also used.

Because holes for the rivets 124 or the bolts for connecting the two members 201 and 202 should be formed on the L-shaped reinforcing component 200, the supplement component (S0 formed by stacking the several fibrous layers should be used.

Meanwhile, with reference to FIG. 11, a maximum load of the L-shaped reinforcing component 120 is applied to the corner portion where the two members 121 and 122 are connected, so the rivets 124 and the connection member 123 installed at the corner portion can serve to prevent deformation of the corner portion. The connection member 123 is formed as an iron plate.

Through the structural analysis, the thickness of the L-shaped reinforcing component 120 formed by mixing the base material (M) and the supplement component (S) and the optimum thickness of the rivets 124 are selected to have the same structure strength as the conventional steel reinforcing component. For example, when the thickness of the steel reinforcing component is 1.8 mm, its structure strength is the same when the L-shaped reinforcing component 120 made of the composite material has the thickness of 2.6 mm and the rivets 124 have the thickness of 1.2 mm.

The required structure strength of the L-shaped reinforcing component 120 varies depending on the size and weight of the refrigerator 10, and according to experimentation, the L-shaped reinforcing component 120 can be optimal when it has the thickness of at least 0.5 mm or greater and at most 5 mm or smaller.

FIGS. 12 and 13 show the sectional configurations of the first and second members 121 and 122, respectively. As shown in FIGS. 12 and 13, the first and second members 121 and 122 have respectively different sectional shapes, and unlike the first member 121, the second member 122 further includes a protrusion 122*a*. The second member 122 is relatively shorter than the first member 121 and several mechanical devices may be installed at a portion where the second member 122 comes in contact. Thus, by taking these differences into consideration, the both members are formed to have respectively different sectional shapes.

As seen in FIG. 12, the first member comprises two contact surfaces perpendicular to each other and a bending portion bent respectively from the two contact surfaces. One of the two contact surfaces is disposed at the bottom of the refrigerator and the other of the two contact surfaces is horizontally disposed at the side wall of the refrigerator. As seen in FIG. 13, the second member comprises two contact surfaces perpendicular to each other and a bending portion bent respectively from the two contact surfaces. One of the two contact surfaces is disposed at the rear wall of the refrigerator and the other of the two contact surfaces is vertically disposed at the side wall of the refrigerator.

The above-mentioned I-shaped reinforcing component includes the combining hole at one side thereof so as to be combined with the entire surface of the side wall forming the inner space of the refrigerator. In addition, the above-mentioned L-shaped reinforcing component includes the combining hole formed at one side thereof so as to be combined with the corner of the bottom of the refrigerator or the mechanic chamber of the refrigerator.

The reinforcing component is combined by the bolt or the rivet through the combining hole. The number of the combining holes is not limited to one but may be formed to be so many as to sufficiently exert the function of the reinforcing component. Thus, it can be easily determined by the person in the art through experimentation.

The construction and operation according to the second exemplary embodiment of the present invention will now be described in detail with reference to the accompanying drawings.

In describing the second embodiment of the present invention, the same parts as and equivalent parts to the above-described construction will be replaced by the corresponding description.

Figure 14:
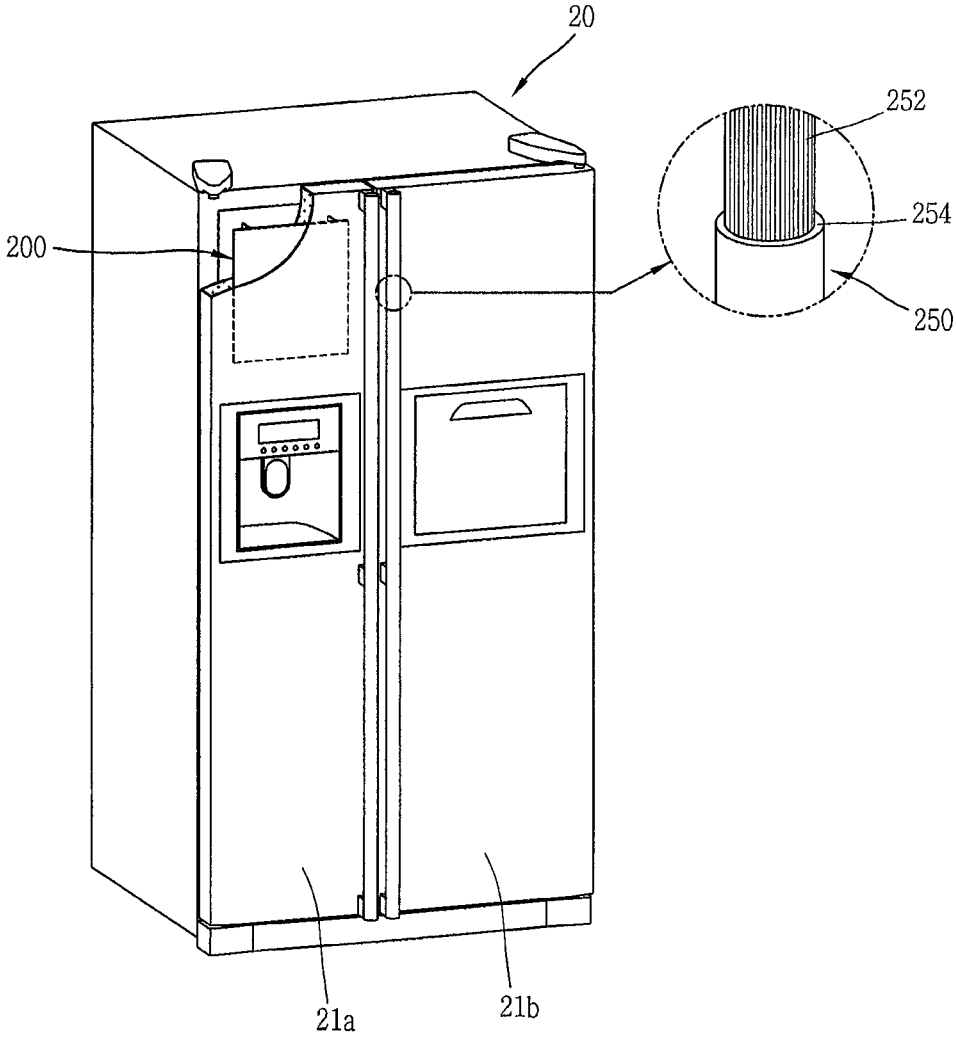
FIG. 14 is a partially cut view showing a door with a reinforcing component according to a second exemplary embodiment of the present invention.
Figure 15:
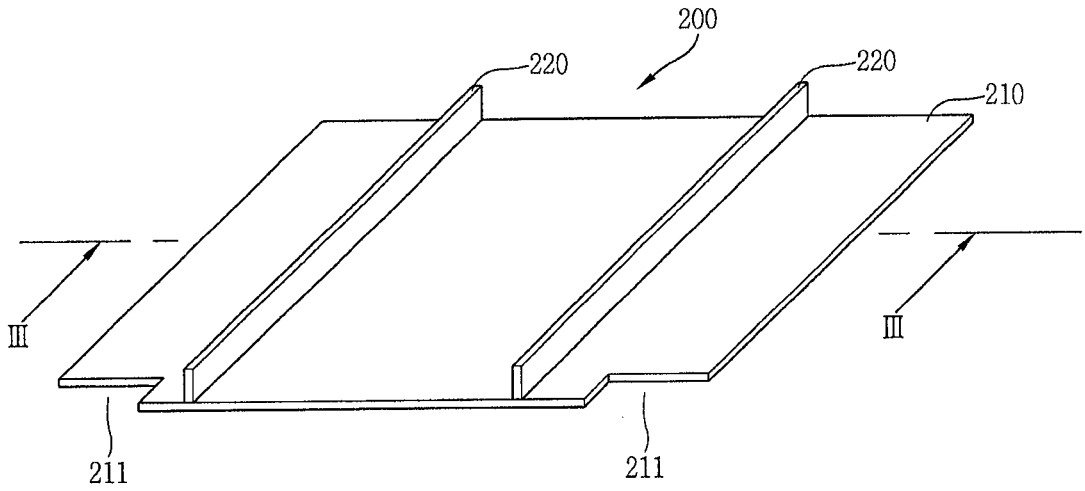
FIG. 15 is a perspective view showing the reinforcing component according to the second exemplary embodiment of the present invention.
Figure 16:
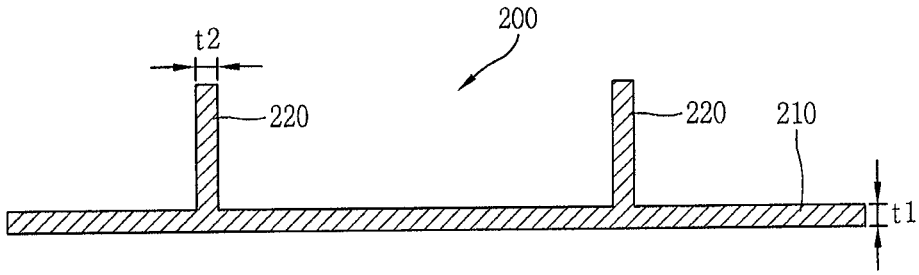
FIG. 16 is a sectional view taken along line III-III in FIG. 15.
Figure 17:
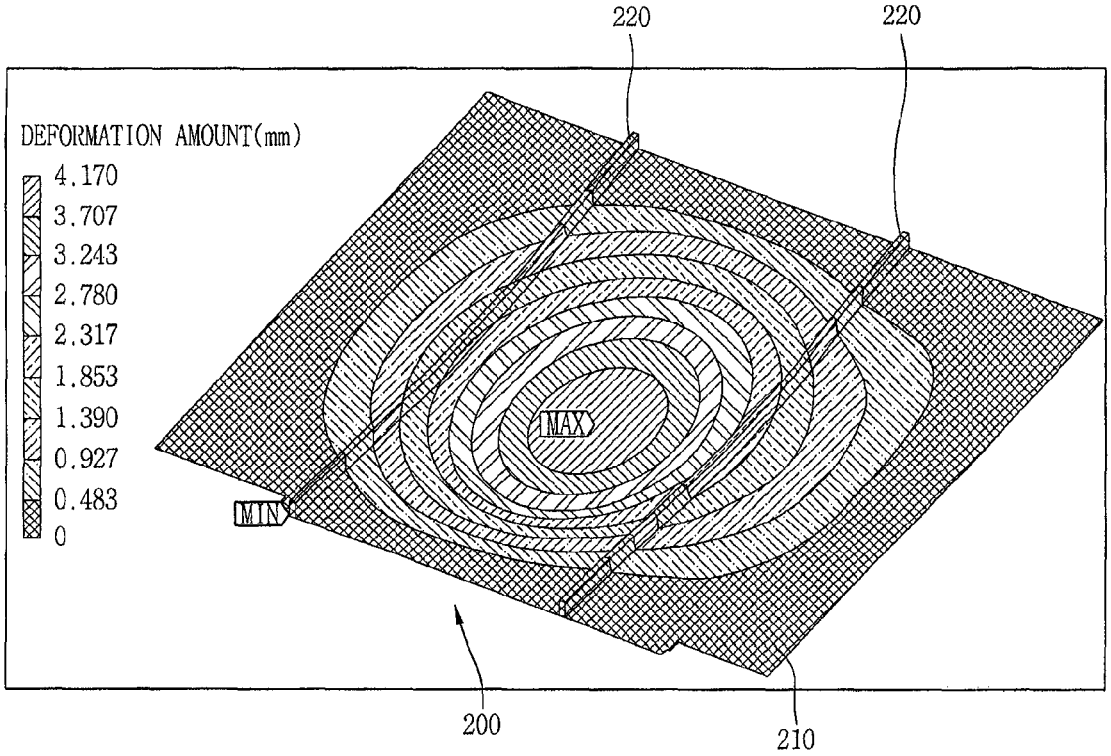
FIG. 17 is a graph showing interpretation of a structure strength according to a load at the reinforcing component in FIG. 15.

FIG. 14 is a partially cut view showing a door with a reinforcing component according to a second exemplary embodiment of the present invention, FIG. 15 is a perspective view showing the reinforcing component according to the second exemplary embodiment of the present invention, FIG. 16 is a sectional view taken along line III-III in FIG. 15, and FIG. 17 is a graph showing interpretation of a structure strength according to a load at the reinforcing component in FIG. 15.

As shown in FIG. 14, a reinforcing component 200 according to the second exemplary embodiment of the present invention is installed at doors 21*a* and 21*b* of the refrigerator that selectively open and close the inner space of the refrigerator 20. When the interior of the door is filled with foam, the reinforcing component 200 prevents the outer plate or the inner plate of the doors from being bent due to the foaming pressure.

Here, the reinforcing component 200 for the refrigerator according to the second exemplary embodiment of the present invention is formed by mixing a base material as a synthetic resin material and a supplement component formed by arranging reinforcing fibers according to the pultrusion method, and is installed at the outer plate or at the inner plate of the refrigerator door.

Namely, the material or fabrication method of the reinforcing component 200 for the refrigerator according to the second exemplary embodiment of the present invention is the same as those described above. The structure of the reinforcing component for the refrigerator according to the second exemplary embodiment of the present invention will now be described in detail.

As shown in FIGS. 15 and 16, the reinforcing component includes a supporter 210 attached on the outer plate or the inner late of the refrigerator doors and ribs 220 protruded from a surface of the supporter 210 to reduce the thickness t1 of the supporter 210.

The supporter 210 is formed to be platy with a large area compared with the thickness t1, and recesses 211 are formed at corners of each end. The recesses 211 are formed to prevent an interference with a device installed at the inner side of the refrigerating door 110 when the supporter 210 is installed at the refrigerator door 110. The recesses 211 can be formed to have a proper shape and size in consideration of the device installed at the inner side of the refrigerating door 110.

Suitably, the thickness t1 of the supporter 210 is at least 0.5 mm or greater and at most 5 mm or smaller.

At least one or more ribs 220 are protrusively formed on one surface of the supporter 210. Preferably, the ribs 220 are protruded at a right angle with the surface of the supporter 210, and traverse the surface of the supporter 210. When a plurality of ribs 220 are formed, they are arranged to be parallel to each other.

By forming the ribs 220 on the surface of the supporter 210, a deformation amount of the supporter 210 can be considerably reduced. The conventional steel reinforcing component 130 does not have such a structure corresponding to the ribs 220 according to the present invention, and when the steel reinforcing component with the thickness of 1.2 mm is used, a deformation amount was 7.5 mm. However, by forming the ribs 220 on the reinforcing component 200 according to the second exemplary embodiment of the present invention, when the thickness of the reinforcing component 200 is 2.0 mm, a deformation amount is 4.2 mm, which is so small compared with that of the conventional steel reinforcing component 130. In this manner, by forming the ribs 220, the strength of the reinforcing component 200 of the doors can be more increased.

The thickness t2 of the ribs 220 is determined in consideration of the thickness t1 of the supporter 210, and the greater the load is applied to the supporter 201, the more effective to form several thick ribs 220.

The both surfaces of the supporter 210 do not need to have the same processing degree. Namely, the opposite surface of the surface where the ribs 220 are formed is to be directly attached to the inner plate or the outer plate of the refrigerator doors 110 by using an adhesive tape, so it needs to be a smooth surface. But the surface with the ribs 220 formed thereon directly contacts with foam, so it does not need to be smooth.

The height of the ribs 220 is determined in consideration of the size of the device installed at the inner side of the refrigerating doors 110 and the width of the refrigerating doors 110.

With reference to FIG. 17, it is noted that the reinforcing component 200 used for the refrigerator door 110 receives a load perpendicular to the surface of the supporter 210. In this case, it is also noted that deformation of the support 210 of the door reinforcing component 200 is maximized at the central portion, namely, between the ribs 220.

According to the result of the structure strength, it is noted that the door reinforcing component 200 according to the second exemplary embodiment of the present invention can tolerate greater strength by having the ribs 220. Without the ribs 220, the deformation amount of the central portion of the supporter 210 would be increased. However, because the ribs 220 are formed such that the direction of the vertical load applied to the supporter 210 and the direction in which the ribs 220 stand correspond to each other, the deformation of the supporter 210 can be reduced.

With the conventional steel reinforcing component, it is difficult to form the ribs due to a processing cost or complicity of a processing method. However, in the method for forming the reinforcing component 200 according to the second exemplary embodiment of the present invention, the sufficiently number of ribs 220 can be formed by simply adding the ribs 220 to the metal mold in the forming process without incurring an additional cost.

The thickness of the supporter 210 can be sufficiently reduced by forming the reinforcing component 200 according to the method for forming such many ribs.

The reinforcing fibers 302 constituting the supporter 210 and the ribs 220 are arranged to cross each other in the lengthwise direction. In this case, the supporter 210 may be sufficient to have the fibrous layer formed by arranging the reinforcing fibers 302 in the crossing manner in the lengthwise direction and does not need to have such fibrous layer formed by arranging the reinforcing fibers 302 in parallel to each other in the lengthwise direction. The reason is because the supporter 210 mainly receives a load perpendicular to the surface thereof without having any other load such as torsion or the like applied thereto.

In addition, as shown in FIG. 14, a handle 250 formed on the door of the refrigerator may be formed of a reinforcing component for the refrigerator by mixing the base material as a synthetic resin material and the supplement component formed by arranging the reinforcing fibers according to the pultrusion method.

Accordingly, because the handle 250, which is made of steel in the related art, is made of the synthetic resin material, the overall weight of the refrigerator can be reduced.

Here, a spray coated film 254 may be formed on an outer circumference of the handle 250. Accordingly, a problem in that the surface of the handle is flawed or scared due to frequent uses of the handle can be prevented and the spray-coated door looks fancy and quality to users.

Meanwhile, an external force works mostly perpendicularly to the lengthwise direction of the handle. Thus, preferably, the reinforcing fibers 252 are formed to be arranged parallel to the lengthwise direction of the handle. The reason is the same as described above regarding the first exemplary embodiment of the present invention, so it will be omitted.

The construction and operation according to a third exemplary embodiment of the present invention will now be described in detail with reference to the accompanying drawings.

In describing the third embodiment of the present invention, the same parts as and equivalent parts to the above-described construction will be replaced by the corresponding description.

Figure 18:
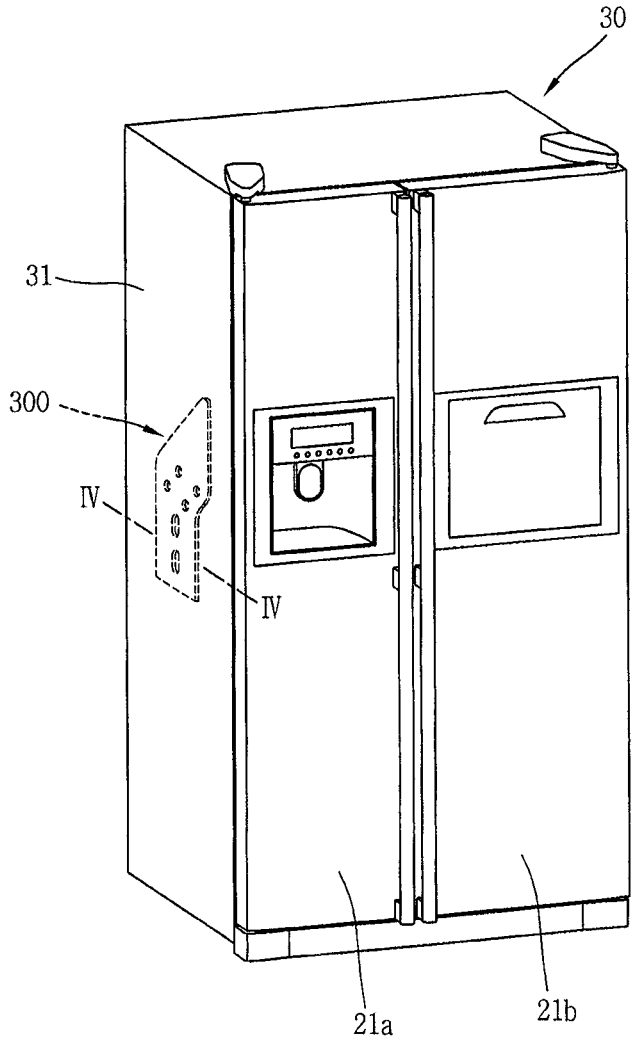
FIG. 18 is a perspective view showing a state that a reinforcing component is installed on a side wall of a refrigerator according to a third exemplary embodiment of the present invention.
Figure 19:
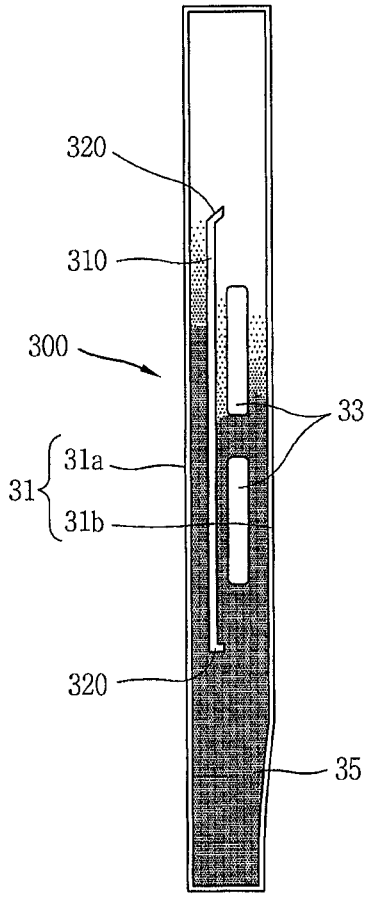
FIG. 19 is a sectional view taken along line IV-IV in FIG. 18.
Figure 20:
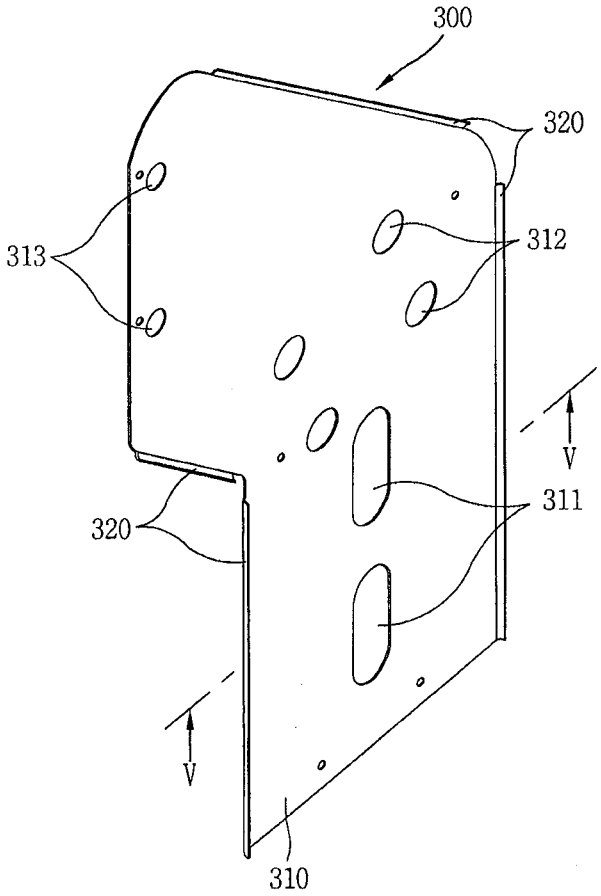
FIG. 20 is a perspective view showing the reinforcing component for a refrigerator in FIG. 18.
Figure 21:
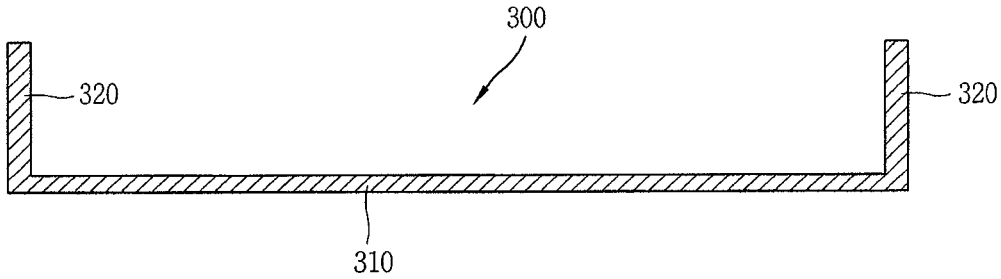
FIG. 21 is a sectional view taken along line V-V in FIG. 20.
Figure 22:
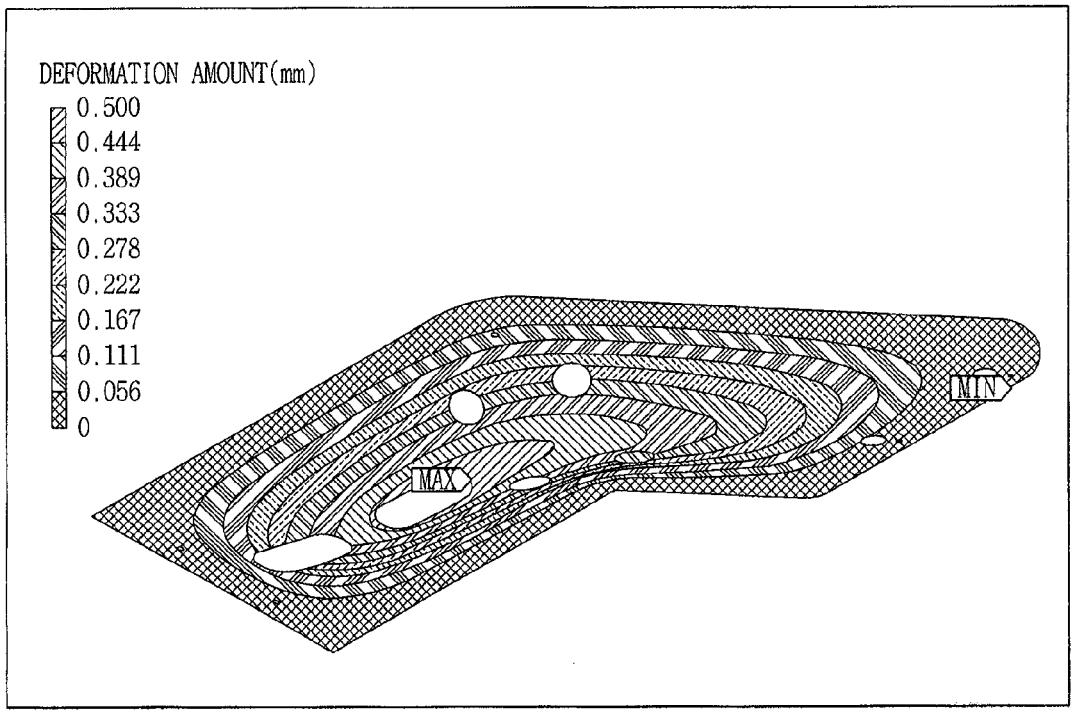
FIG. 22 is a graph showing interpretation of a structure strength according to a load at the reinforcing component in FIG. 20.

FIG. 18 is a perspective view showing a state that a reinforcing component is installed on a side wall of a refrigerator according to a third exemplary embodiment of the present invention, FIG. 19 is a sectional view taken along line IV-IV in FIG. 18, FIG. 20 is a perspective view showing the reinforcing component for a refrigerator in FIG. 18, FIG. 21 is a sectional view taken along line V-V in FIG. 20, and FIG. 22 is a graph showing interpretation of a structure strength according to a load at the reinforcing component in FIG. 20.

With reference to FIGS. 18 and 19, cooling air ducts 33 for supplying cooling air to the inner space of a refrigerator 30 are formed at an inner side of a side wall 31 of the refrigerator.

A reinforcing component 300 for a refrigerator according to the third exemplary embodiment of the present invention is installed between the cooling air ducts 33 and an outer plate 31*a* of the side 31 of the refrigerator. The reinforcing component 300 is installed to prevent formation of a bent portion on the outer plate 31*a* due to the cooling air ducts 33, and is installed to correspond to the structure of disposition of the cooling air ducts 33.

Foam 35 is filled in the interior of the side wall 31. The foam 35 is filled between the cooling air ducts 33 and the reinforcing component 300 and between the outer plate 31*a* of the side wall and the reinforcing component 300.

Here, the reinforcing component 300 according to the third exemplary embodiment of the present invention is formed by mixing a base material formed of a synthetic resin material and a supplement component formed by arranging reinforcing fibers according to the pultrusion method, and installed at the interior of the side wall forming the inner space of the refrigerator.

Namely, the material and the fabrication method of the reinforcing component 300 according to the third exemplary embodiment of the present invention are the same as described above.

The structure of the reinforcing component for the refrigerator according to the third exemplary embodiment of the present invention will now be described in detail.

As shown in FIG. 20, the reinforcing component 300 for the refrigerator includes a supporter 310 formed with a large size to support eh outer plate 31*a* of the side wall 31, and blades 320 formed to be bent from both ends of the supporter 310. The cooling air ducts 33 are positioned at one side of the supporter 310, and the flow direction of the cooling air is from a lower side to an upper side. Because the supporter 310 has the bent shape, the cooling air ducts 33 also have a bent shape.

Multiple holes 311, 312 and 313 are formed on the supporter 310. The holes 311, 312 and 313 serve to firmly fix the supporter 310 within the outer plate 31*a*. Namely, the foam 35, which is foamed and flows along the both sides of the supporter 310, also flows through the holes 311, 312 and 313 and is hardened on both surfaces of the supporter 310 to make the supporter 310 firmly fixed within the supporter 310.

With reference to FIG. 21, in order to allow the foam filled between the supporter 310 and the cooling air duct 33 to be uniformly foamed and flow, the blades 320 are formed to be bent at both end portions of the supporter 310.

Without the blades 320, the foaming and flowing of the foam 35 between the supporter 310 and the cooling air ducts 35 would quickly go up to push the supporter 310 toward the outer plate 31*a*. Then, the space between the outer plate 31*a* and the supporter 310 would be narrowed, in which the foam 35 would not be sufficiently filled. The insufficient filling of the foam 35 would degrade the appearance of the outer plate 31*a* of the side wall 31.

Thus, in order to reduce the insufficient filling of the foam 35, the blades 320 are bent to be formed at the both end portions of the supporter 310. The blades 320 should be necessarily formed at the support 310 to perform the role of the side reinforcing component 300. It would be more effective for the blades 320 to be bent perpendicularly to the supporter 310. Here, preferably, the height of the blades 320 is 10 mm in consideration of the space between the outer plate 31*a* of the side wall 31 of the refrigerator and the distance with the cooling air duct 33.

With reference to FIG. 22, it is noted that the reinforcing component 300 used for the side wall 31 of a refrigerating chamber mainly receives a load perpendicular to the surface of the supporter 310. In this case, formation of the support 310 of the reinforcing component 300 for the refrigerator is maximized at the central portion of the supporter 310.

When analyzed by numerical values, it is noted that, when the conventional steel reinforcing component with a thickness of 1 mm is used, a deformation amount is 0.5 mm, and when the reinforcing component 300 according to the third exemplary embodiment of the present invention is used, a deformation amount over the thickness of 2.00 mm is 0.48 mm, which is smaller by 4% compared with the conventional steel reinforcing component, and a deformation amount over the thickness of 3.0 mm is 0.15 mm, which is smaller by 70% compared with the conventional steel reinforcing component.

In this manner, the vertical pressure load is mainly applied to the reinforcing component 300 for the refrigerator according to the third exemplary embodiment of the present invention, the suitable thickness of the supporter 310 should be at least 0.5 mm or greater and at most 5 mm or smaller.

In addition, because the surface of the supporter 310 of the reinforcing component 300 for the refrigerator mainly receives load or a pressure load perpendicular to the surface, the reinforcing fibers are arranged to cross each other in the longitudinal direction as a single layer.

Namely, as for the reinforcing component 300 for the refrigerator, the vertical load is largely applied to the surface of the supporter 310 while a torsional moment is not applied, the reinforcing fibers do not need to be arranged to form both a fibrous layer by staking reinforcing fibers to cross each other in the lengthwise direction and a fibrous layer with reinforcing fibers arranged to be parallel to each other in the lengthwise direction.

The construction and operation according to a fourth exemplary embodiment of the present invention will now be described in detail with reference to the accompanying drawings.

Figure 23:
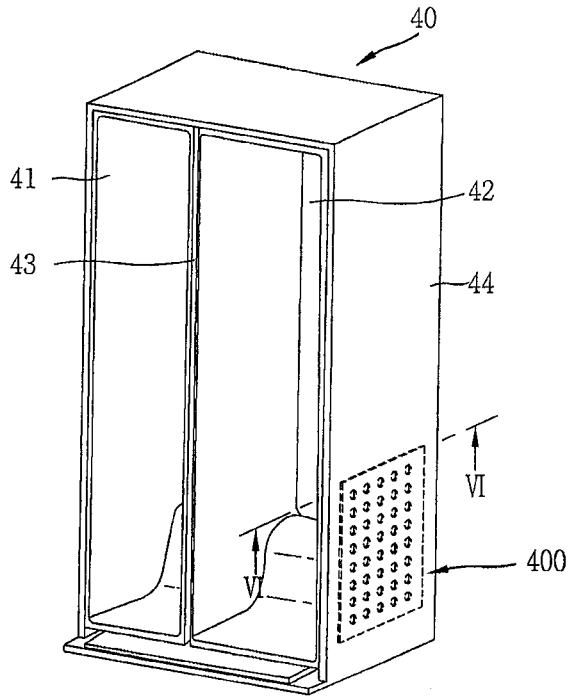
FIG. 23 is a perspective view showing the interior of a refrigerator according to a fourth exemplary embodiment of the present invention.
Figure 24:
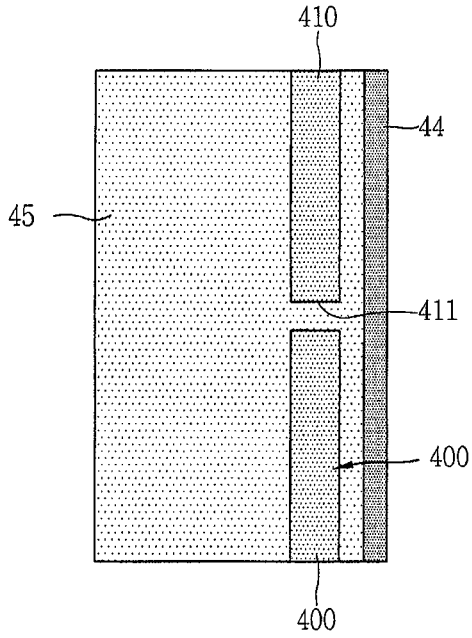
FIG. 24 is a sectional view taken along line VI-VI in FIG. 23.
Figure 25:
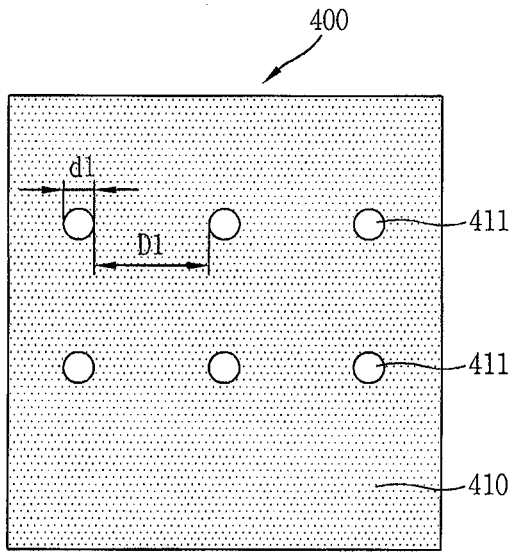
FIG. 25 is a plan view showing plastic foam in FIG. 24.

FIG. 23 is a perspective view showing the interior of a refrigerator according to a fourth exemplary embodiment of the present invention, FIG. 24 is a sectional view taken along line VI-VI in FIG. 23, and FIG. 25 is a plan view showing plastic foam in FIG. 24.

As shown in FIGS. 23 and 24, a refrigerator 40 with a reinforcing component according to the fourth exemplary embodiment of the present invention includes a freezing chamber 41 and a refrigerating chamber 42, and a separation wall 43 formed between the freezing chamber 141 and the refrigerating chamber 42 to separate both spaces thereof.

A polyurethane foaming solution 45 is filled in the interior of a side wall 44 to increase a cooling effect. A reinforcing component 400 is installed at an inner side of a side wall 44 in order to prevent the side wall 44 from being contracted to thus avoid generation of a bent portion on the appearance of the side wall 44 when the foaming solution 45 filled at the inner side the side wall 44 is cooled and contracted.

The reinforcing component 400 includes plastic foam with a through hole 411 to allow the foaming solution 45 filling the interior of the side wall 44 to flow therethrough.

The plastic foam 410 has the thickness of 2 mm to 30 mm and is made of polyurethane, polyester or an epoxy group. The plastic foam 410 is formed to be platy with a certain area. Because the foaming solution 45 is widely filled to be contracted to form a bent portion within the side wall 44 of the refrigerator 40, the plastic foam 410 should have a sufficiently large area. In this case, it would be effective for the platy plastic foam 410 to have the width of 0.1 square meters or greater in consideration of foaming quality.

Also, even if the foaming solution 45 contracts or shrinks, the plastic foam 410 itself should accommodate or absorb the deformations caused by the contracted foaming solution 45 without transferring such deformations to the exterior. For this purpose, it would be effective for the plastic foam 410 to have elasticity. According to structural analysis, it was found that the elastic coefficient of the plastic foam 410 should be at least 1 MPa or greater.

Meanwhile, the plastic foam 410 is installed to be spaced apart from the surface of the side wall 44 of the refrigerator 40. By having such a gap between the plastic foam 410 and the surface of the side wall 44 of the refrigerator 40, the foaming solution 45 can be allowed to infiltrate into the gap and bonded to both surfaces of the plastic foam 410 to firmly fix the plastic foam 410.

In order to allow a sufficient amount of foaming solution 45 to be introduced to between the wall surface of the side wall 44 of the refrigerator 40 and the plastic foam 410, the through portion 411 is formed.

With reference to FIG. 25, a plurality of through portions 411 are formed on the plastic foam 410. It would be effective for the plurality of through portions 411 to have a circular shape but, without being limited thereto, they may have various shapes such as a rectangular shape or the like. If the through portion 411 has the circular shape, its diameter d1 has a value of 3 mm to 15 mm. Such diameter d1 would provide a minimal size that allows the foaming solution 45 to be infiltrated therethrough, while minimizing any marks or traces of the through portions 411 from being formed on the surface of the side wall 44 of the refrigerator 40.

In order to firmly attach the plastic foam to the surface of the side wall 44 of the refrigerator 410 without using a double-sided tape, the foaming solution 45 needs to infiltrate evenly between the plastic foam 410 and the surface of the side wall 44 of the refrigerator. For this purpose, the through portions 411 are formed at certain distance from the neighbor through portions 411. The distance D1 between neighboring (adjacent) through holes 411 has a value that is an integer multiple of the diameter d1 of the through portion 411 itself. Considering the amount of the foaming solution 45 that flows through the through portions 411, it would be appropriate for the distance D1 between adjacent through portions 411 to be about 3 to 15 times the diameter d1 of the through portion 111.

In the present exemplary embodiment, the side-by-side type refrigerator 40 has been described, but the plastic foam 410 is not only applied to the side-by-side type refrigerator but also applied to various refrigerating and freezing device such as a refrigerator having a freezing chamber and a refrigerating chamber up and down or a kimchi refrigerator.

The construction and operation according to a fifth exemplary embodiment of the present invention will now be described with reference to the accompanying drawings.

Figure 26:
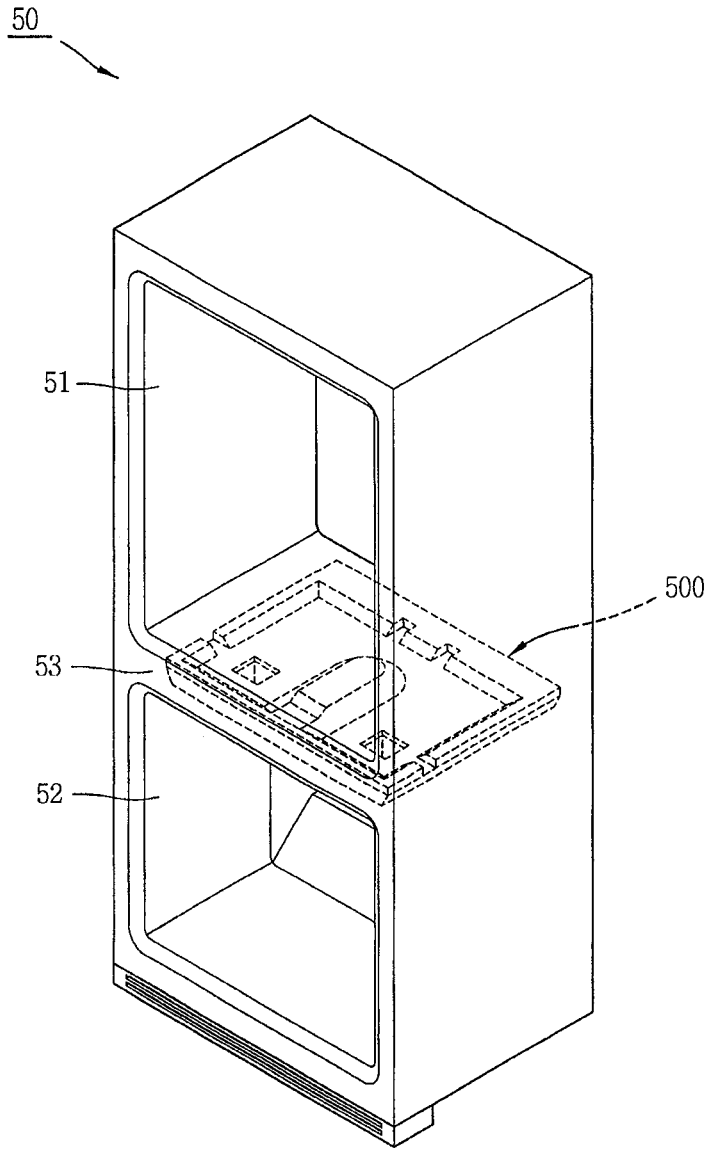
FIG. 26 is a perspective view showing the interior a refrigerator with a reinforcing component according to a fifth exemplary embodiment of the present invention.
Figure 27:
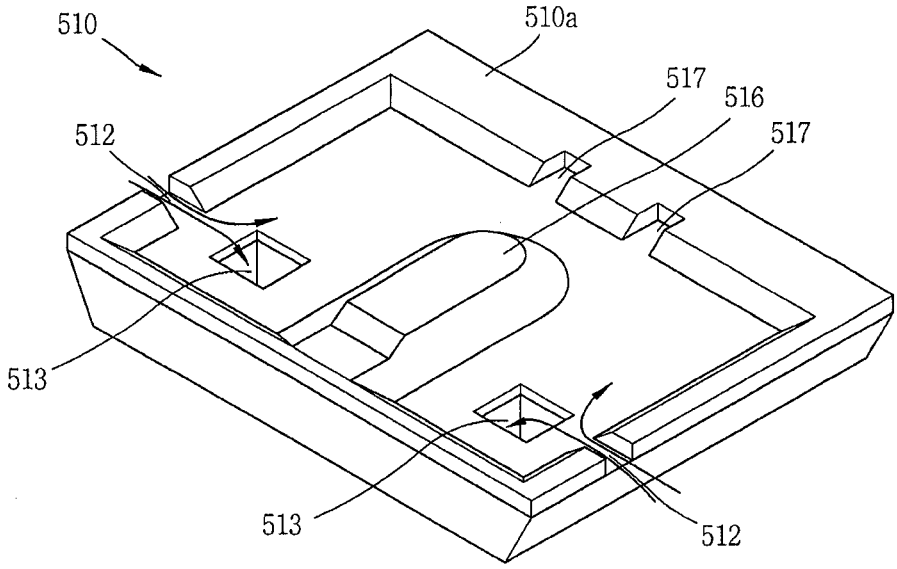
FIGS. 27 and 28 are perspective views showing one example of a reinforcing component used as a separation wall of the refrigerator in FIG. 26.
Figure 28:
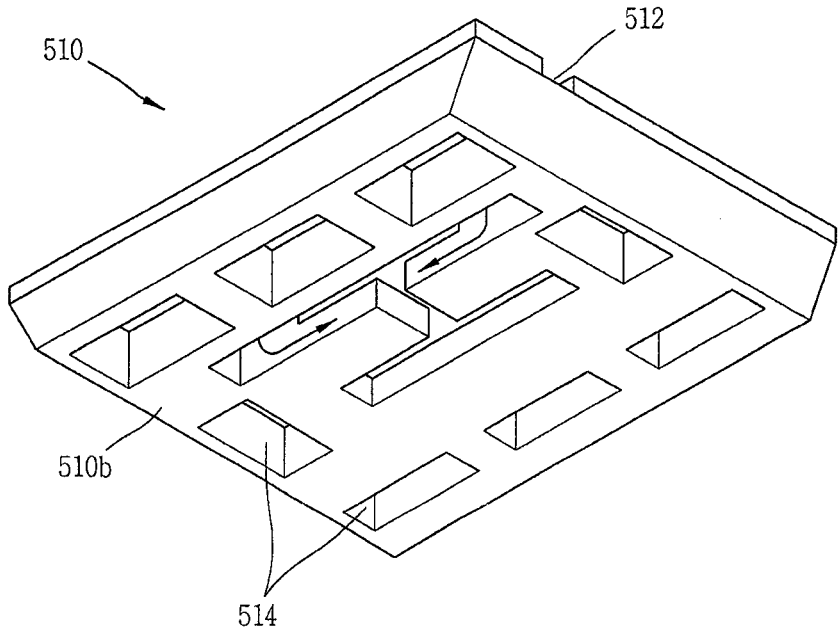
Figure 29:
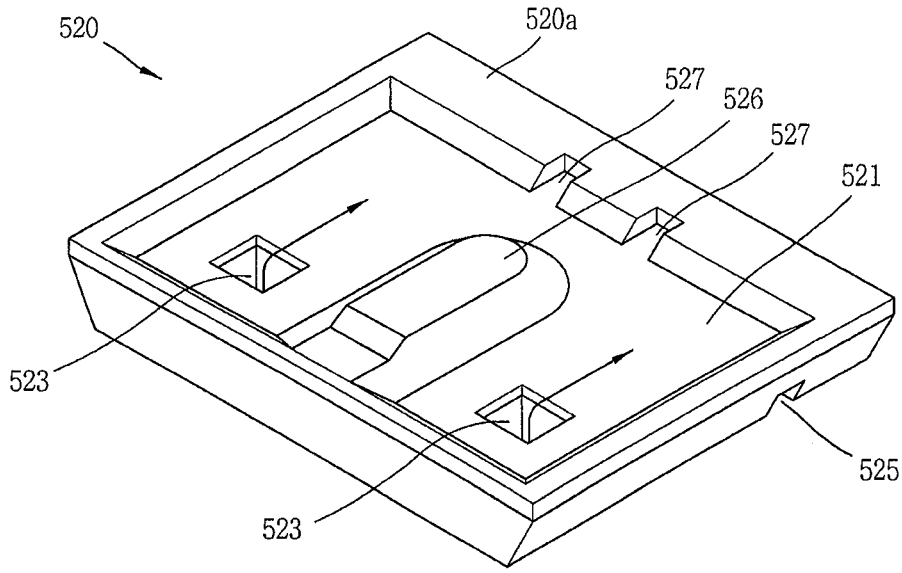
FIGS. 29 and 30 are perspective views showing another example of the reinforcing component used as a separation wall of the refrigerator in FIG. 26.
Figure 30:
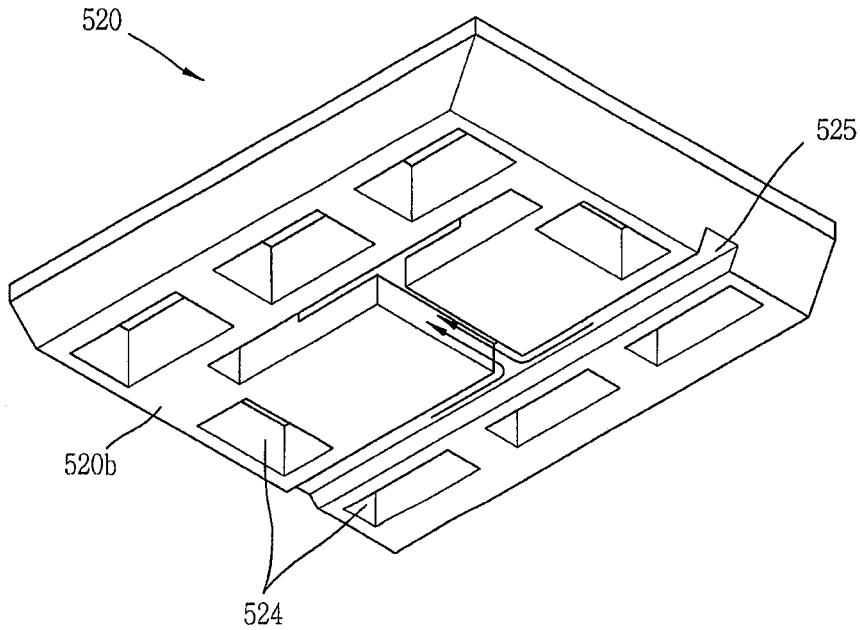

FIG. 26 is a perspective view showing the interior a refrigerator with a reinforcing component according to a fifth exemplary embodiment of the present invention, FIGS. 27 and 28 are perspective views showing one example of a reinforcing component used as a separation wall of the refrigerator in FIG. 26, and FIGS. 29 and 30 are perspective views showing another example of the reinforcing component used as a separation wall of the refrigerator in FIG. 26.

As shown in FIG. 26, a refrigerator 50 employing a reinforcing component according to the fifth exemplary embodiment of the present invention includes a freezing chamber 51 and a refrigerating chamber 52, and the freezing chamber 51 and the refrigerating chamber 52 are spatially divided by a separation wall 53.

Regardless of the method for spatially disposing the freezing chamber 51 and the refrigerating chamber 52, namely, regardless of a vertical arrangement or a horizontal arrangement, the separation wall 53 is formed between the freezing chamber 51 and the refrigerating chamber 52.

The separation wall 53 is filled with polyurethane foam therein and a vacuum insulator is installed therein. In addition, a reinforcing component 500 is installed to prevent an outer plate of the separation wall 53 from being adhered to a foaming solution and drawn inwardly in the process that the foaming solution is contracted.

One example of the reinforcing component according to the fifth exemplary embodiment of the present invention will now be described in detail.

FIG. 27 shows the reinforcing component in FIG. 26 viewed from an upper side and FIG. 28 shows the reinforcing component in FIG. 26 viewed from a lower side.

As shown in FIGS. 27 and 28, the reinforcing component for a refrigerator according to the fifth exemplary embodiment of the present invention uses a plastic foam 510 made of polyurethane, epoxy, polyester group or the like.

The plastic foam 510 includes a foaming solution receiving part 511 allowing the polyurethane foaming solution to flow therein, and cavities 514 formed to reduce the material and the weight of the plastic foam 510.

The foaming solution receiving part 511 is formed to be recessed on an upper surface 510*a* of the plastic foam 510. The recessed depth of the foaming solution receiving part 511 should have a proper value to allow the foaming solution to evenly flow on the entire area of the foaming solution receiving part 511. If the depth of the foaming solution receiving part 511 is too small, the polyurethane foaming solution may be insufficiently filled, or if the depth of the foaming solution receiving part 511 is too large, the foaming solution would be increased to increase the weight of the refrigerator 50. Thus, it would be effective for the foaming solution receiving part 511 to have the depth of at least 5 mm or greater.

Meanwhile, the foaming solution is not immediately filled in the foaming solution receiving part 511, but the foaming solution filled at the inner side of the separation wall 53 is supplied to the foaming solution receiving part 511, so in order to effectively introduce the foaming solution into the foaming solution receiving part 511, inlets 512 are formed at the plastic foam 510.

The inlets 512 are formed at the side where the foaming solution receiving part 511 such that they communicate with the received foaming solution receiving part 511. At least two or more inlets 512 are formed. By allowing the foaming solution to be introduced from the inlets 512 formed at both sides of the foaming solution receiving part 511, time taken for filling can be reduced.

The width of the inlet 512 should be designed to have a value that can minimize a flow resistance of the polyurethane foaming solution. When the width of the inlet 512 is too large, a bent portion may be generated on the outer plate of the separation wall 53 while the foaming solution is contracted. Thus, the inlet 512 should have the width of at least 10 mm or greater and at most 50 mm or smaller.

At least two or more first communicating holes 513 are formed at the foaming solution receiving part 511 in order to send the foaming solution toward a lower surface 510*b* of the plastic foam 510. In order to prevent the foaming solution introduced from the both inlets 512 from being abruptly mixed to generate air bubbles to cause insufficient filling, a mixture delay part 516 is protrusively formed between the first through holes 513.

The mixture delay part 516 is formed to have a certain length traversing the foaming solution receiving part 511. In this case, the mixture delay part 516 does not completely divide the foaming solution receiving part 511, and in order to allow the foaming solution to be mixed gradually, one end of the mixture delay part 516 is separated from the upper surface 510*a* of the plastic foam 510. Through the separated gap, the foaming solution is mixed. Flow speed reducing parts 517 are formed at the upper surface 510*a* of the plastic foam 510 in order to prevent an increase of a flow speed of the foaming solution introduced through the separated gap.

The cavities 514 are formed on the lower surface 510*b* of the plastic foam 510. In order to reduce the weight of the plastic foam 510, the cavities 514 are formed as recesses on the lower surface 510*b* of the plastic foam 510 and do not penetrate through the upper surface 510*a* of the plastic foam 510. Multiple cavities 514 are formed such that they are evenly distributed on the entire lower surface 510*b* of the plastic foam 510.

When the reinforcing component 500 according to the fifth exemplary embodiment of the present invention is installed at the inner side of the separation wall 53, the foaming solution filled within the separation wall 53 first fills the foaming solution receiving part 511 through the inlets 512 as indicated by solid arrows as shown in FIGS. 27 and 28 and then flows toward the lower surface 510*b* with the cavities 514 formed thereon through the first communicating holes 513.

The area to which the foaming solution seeps in between the plastic foam 510 and the separation wall 53 of the refrigerator 50 has a relation with the structure strength of the separation wall 53. When the area of the foaming solution filled between the plastic foam 510 and the separation wall 53 is too small compared with the area of the plastic foam 510, the structure strength for fixing the plastic foam 510 weakens. Thus, in order to prevent the weakening of the structure strength, more than 50% of the surface area of the entire plastic foam 510 should contact with the foaming solution.

Meanwhile, before the foaming solution infiltrates, air exists in the foaming solution receiving part 511. Thus, an air exhaust passage (not shown) may be formed to exhaust air while the foaming solution is introduced. In addition, without forming the passage for exhausting air, a gap (not shown) of 3 mm or smaller may be formed on a front surface of the plastic foam 510 and the separation wall 53, through which air can be exhausted.

Another example of the reinforcing component according to the fifth exemplary embodiment of the present invention is shown in FIGS. 29 and 30.

With reference to FIGS. 29 and 30, a foaming solution receiving part 521 is formed to be recessed on a lower surface 520*a* of a plastic foam 520, and cavities 524 are formed to be recessed on a lower surface 520*b* of the plastic foam 520.

The cavities 524 are formed to be recessed on the lower surface 520*b* of the plastic foam 520 to reduce the weight of the plastic foam 520, and do not penetrate the upper surface 520*a* of the plastic foam 520. Multiple cavities 524 are formed such that they are evenly distributed on the entire lower surface 520*b* of the plastic foam 520.

The foaming solution receiving part 521 is formed to be recessed on the upper surface 520*a* of the plastic foam 520. If the depth of the foaming solution receiving part 521 is too small, the polyurethane foaming solution would be insufficiently filled, and if the depth of the foaming solution receiving part 521 is too large, the foaming solution would increase to increase the weight of the refrigerator 50. Thus, it would be effective for the foaming solution receiving part 521 to have a depth of at least 5 mm or greater.

A foaming solution flow path 525 for guiding the foaming solution to be filled at the inner side of the separation wall 53 is formed on the lower surface 520*b* of the plastic foam 520. The foaming solution flow path 125 corresponds to the inlets 512 as shown in FIG. 27. The foaming solution flow path 525 is formed to traverse the lower surface 520*b* of the plastic foam 520, along which the foaming solution filled at the inner side of the separation wall 53 is supplied from both sides.

Here, the foaming solution path 525 should be designed such that its width minimizes a flow resistance of the foaming solution. If the width of the foaming solution path 5125 is too large, a bent portion would be generated on the outer plate of the separation wall 53 when the foaming solution is contracted. Thus, the foaming solution path 525 should have a width of at least 10 mm or greater and at most 50 mm or smaller.

In order to send the foaming solution introduced through the foaming solution path 525 formed on the lower surface 520*b* of the plastic foam 520 to the foaming solution receiving part 521, at least two or more second communicating holes 523 are penetratingly formed to allow the foaming solution path and the foaming solution receiving part to communicate with each other.

In order to prevent the foaming solution introduced from the communicating holes 523 from being abruptly mixed to generate air bubbles to cause insufficient filling, a mixture delay part 526 is protrusively formed between the communicating holes 523.

The mixture delay part 526 is formed to have a certain length traversing the foaming solution receiving part 521. In this case, the mixture delay part 526 does not completely divide the foaming solution receiving part 511, and in order to allow the foaming solution to be mixed gradually, one end of the mixture delay part 526 is separated from the upper surface 520*a* of the plastic foam 520. Through the separated gap, the foaming solution is mixed. Flow speed reducing parts 527 are formed at the upper surface 520*a* of the plastic foam 520 in order to prevent an increase of a flow speed of the foaming solution as the flow path is suddenly narrowed while the foaming solution passes through the separated gap.

INDUSTRIAL APPLICABILITY

As so far described, the refrigerator 100 having the freezing chamber and the refrigerating chamber formed at the upper and lower portions thereof have been described, but the plastic foams 110 and 120 are not only applied for the upper-lower type refrigerator but also applied for various refrigerating and freezing devices such as the side-by-side type refrigerator or the kimchi refrigerator in which the freezing chamber and the refrigerating chamber are formed at left and right portions thereof.

The invention claimed is:

1. A refrigerator comprising:

a case forming an inner space of the refrigerator; and a door configured to open or close the inner space, wherein the case comprises:

an outer plate;

an inner plate disposed at an inner side of the outer plate and forming the inner space;

foam located between the outer plate and the inner plate; and a reinforcing component disposed at an inner side of the outer plate and contacting the foam, wherein the reinforcing component is formed by a pultrusion method by mixing a base component made of synthetic resin and a supplement component formed by arranging reinforcing fibers, wherein the reinforcing component comprises:

a first reinforcing component disposed at a front surface of the outer plate; and a second reinforcing component installed at a corner of a bottom of the case or at a mechanic chamber, wherein the reinforcing component is superior to iron in a specific strength, wherein the first reinforcing component has a length corresponding to 60% to 95% of an overall height of the refrigerator, wherein the second reinforcing component simultaneously supports the bottom of the refrigerator and a rear surface of a lower portion of the refrigerator, wherein the second reinforcing component has a first member supporting the bottom of the refrigerator, a second member supporting the rear surface of the lower portion of the refrigerator, and connection members attached on the surfaces of the first member and second member, wherein the second reinforcing component has an arrangement direction of reinforcing fibers forming the supplement component, the arrangement direction being different from that of the first reinforcing component, wherein the supplement component of the second reinforcing component is formed by staking at least two or more fibrous layers with fibers arranged in two directions to cross each other to tolerate the higher strength, wherein the first member comprises two contact surfaces perpendicular to each other and a bending portion bent respectively from the two contact surfaces, a first contact surface of the two contact surfaces of the first member being disposed at the bottom of the refrigerator, and a second contact surface of the two contact surfaces of the first member being horizontally disposed at the side wall of the refrigerator, wherein the second member comprises two contact surfaces perpendicular to each other and a bending portion bent respectively from the two contact surfaces, a first contact surface of the two contact surfaces of the second member being disposed at the rear wall of the refrigerator, and a second contact surface of the two contact surfaces of the second member being vertically disposed at the side wall of the refrigerator, and wherein one of the connection members connects the first contact surface of the first member with the first contact surface of the second member, and an other of the connection members connects the second contact surface of the first member with the second contact surface of the second member.

2. The refrigerator of claim 1, wherein the reinforcing component has a square shaped or an I-shaped cross-section.

3. The refrigerator of claim 1, wherein the base component is epoxy or polyester.

4. The refrigerator of claim 1, wherein the reinforcing component comprises a combining hole formed at one side thereof so as to be combined with a front surface of a side wall constituting an internal space of the refrigerator.

5. The refrigerator of claim 1, wherein the second reinforcing component has an 'L' shape.

6. The refrigerator of claim 1, wherein the reinforcing component comprises a combining hole formed at one side thereof so as to be combined with a corner of the bottom of the refrigerator or a mechanic chamber of the refrigerator.

7. The refrigerator of claim 1, wherein the door comprises:
an outer plate;
an inner plate disposed at an inner side of the outer plate;
foam located between the outer plate and the inner plate; and
a door reinforcing component disposed at an inner side of the outer plate,
wherein the door reinforcing component comprises:
a base component made of a synthetic resin material; and
a supplement component formed by arranging reinforcing fibers,
whereby the base component and the supplement component are mixed and formed according to a pultrusion method, and installed on an outer plate or an inner plate of a door of the refrigerator.

8. The refrigerator of claim 7, wherein the door reinforcing component comprises:
a supporter attached on the outer plate or inner plate of the refrigerator door; and
at least one or more ribs formed to protrude from a surface of the supporter.

9. The refrigerator of claim 7, wherein the supplement component is formed by arranging the reinforcing fibers such that they have at least two or more directionality.

10. The refrigerator of claim 7, wherein the base component is epoxy or polyester.

11. The refrigerator of claim 7, wherein when two or more ribs are formed, the ribs are formed to be parallel to each other.

12. The refrigerator of claim 7, wherein the door further comprises a handle,
wherein the handle comprises:
a base component made of a synthetic resin material; and
a supplement component formed by arranging reinforcing fibers,
whereby the base component and the supplement component are mixed and formed according to a pultrusion method in order to form a handle of a door of the refrigerator.

13. The refrigerator of claim 12, wherein a spray coated film is formed on an outer circumferential surface of the handle.

14. The refrigerator of claim 12, wherein the supplement component is formed by arranging the reinforcing fibers such that they are parallel to a lengthwise direction of the handle.

15. The refrigerator of claim 12, wherein the base material is epoxy or polyester.

16. The refrigerator of claim 1, further comprising a third reinforcing component disposed at an inner side of a side wall of the case,
wherein the third reinforcing component comprises:
a base component made of a synthetic resin material; and
a supplement component formed by arranging reinforcing fibers,
whereby the base component and the supplement component are mixed and formed according to a pultrusion method, and installed at the interior of a side wall forming an inner space of the refrigerator.

17. The refrigerator of claim 16, wherein the third reinforcing component comprises:
a supporter installed between an outer plate of the side wall and a duct that supplies cooling air into the inner space of the refrigerator; and
a blade formed to be bent toward the duct at an end of the supporter.

18. The refrigerator of claim 17, wherein the supporter comprises multiple holes.

19. The refrigerator of claim 16, wherein the supplement component is formed by arranging the reinforcing fibers such that they have at least two or more directionality.

20. The refrigerator of claim 16, wherein the base component of the third reinforcing component is epoxy or polyester.

21. The refrigerator of claim 16, further comprising a fourth reinforcing component disposed at an inner side of the outer plate at a side wall of the case,
wherein the fourth reinforcing component includes plastic foam installed at an inner side of an outer plate of a side wall forming an inner space of the refrigerator and having a through hole to allow a foaming solution filling the interior of the side wall to flow therethrough.

22. The refrigerator of claim 21, wherein multiple through holes are formed to be spaced apart from each other.

23. The refrigerator of claim 22, wherein the distance between the through holes is 3 times to 15 times the diameter of the through holes.

24. The refrigerator of claim 21, wherein the plastic foam is made of polyurethane, epoxy or polyester.

25. The refrigerator of claim 21, wherein the plastic foam is installed to be spaced apart from an inner surface of the side wall.

26. The refrigerator of claim 1, wherein the first and second members have different cross-sectional shapes,
wherein the second member further includes a protrusion, and
wherein the first member does not have a protrusion.

27. The refrigerator of claim 1, wherein the second member is relatively shorter than the first member.

28. A refrigerator comprising:
a case having an inner space; and
a door configured to open and close the inner space,
wherein the case comprises a separation wall configured to divide the inner space of the case into upper and lower spaces,
wherein plastic foam is installed at an inner side of the separation wall, and
wherein the plastic foam comprises:
a foaming solution receiving part formed to be recessed on an upper surface of the plastic foam and filled with a foaming solution that fills the interior of the separation wall;
at least one or more cavities formed to be recessed on a lower surface of the plastic foam; and
a first communicating hole allowing the foaming solution receiving part and the cavities to communicate with each other.

29. The refrigerator of claim 28, wherein the plastic foam further comprises:
an inlet formed on the upper surface of the plastic foam and guiding the foaming solution so as to be introduced into the foaming solution receiving part.

30. The refrigerator of claim 29, wherein the foaming solution flows to the cavities from the foaming solution receiving part through the first communication hole.

31. The refrigerator of claim 28, wherein the plastic foam further comprises:

a foaming solution flow path formed on the lower surface of the plastic foam to guide the foaming solution so as to be introduced to and filled in the separation wall.

32. The refrigerator of claim 31, wherein the plastic foam further comprises:

a second communicating hole allowing the foaming solution flow path and the foaming solution receiving part to communicate with each other.

33. The refrigerator of claim 32, wherein the foaming solution flows to the foaming solution receiving part through the foaming solution flow path after passing through the second communicating hole.

34. The refrigerator of claim 28, wherein the plastic foam is made of polyurethane, epoxy or polyester.

* * * * *